US012797708B2

(12) United States Patent
Lay et al.

(10) Patent No.: US 12,797,708 B2
(45) Date of Patent: Nov. 17, 2026

(54) UNCOVERED-WHEEL PITCHING MACHINE WITH CAST HUB AND SAFETY SHIELD

(71) Applicant: World Sports Products, Inc., St. George, UT (US)

(72) Inventors: William Coleman Lay, St. George, UT (US); Joseph Coleman Lay, St. George, UT (US)

(73) Assignee: World Sports Products, Inc., St. George, UT (US)

( * ) Notice: Subject to any disclaimer, the term of this patent is extended or adjusted under 35 U.S.C. 154(b) by 108 days.

(21) Appl. No.: 18/614,352

(22) Filed: Mar. 22, 2024

(65) Prior Publication Data

US 2025/0295973 A1 Sep. 25, 2025

(51) Int. Cl.

| | |
|---|---|
| ***A63B 69/40*** | (2006.01) |
| ***A63B 69/00*** | (2006.01) |
| ***A63B 71/00*** | (2006.01) |
| *A63B 102/18* | (2015.01) |

(52) U.S. Cl.

CPC ..... *A63B 69/406* (2013.01); *A63B 69/0002* (2013.01); *A63B 71/0054* (2013.01); *A63B 2069/0008* (2013.01); *A63B 2069/0011* (2013.01); *A63B 2069/402* (2013.01); *A63B 2071/009* (2013.01); *A63B 2102/18* (2015.10); *A63B 2102/182* (2015.10); *A63B 2225/093* (2013.01)

(58) Field of Classification Search

CPC ... A63B 69/40; A63B 69/406; A63B 71/0054; F16D 1/06; F16D 1/08

See application file for complete search history.

(56) References Cited

U.S. PATENT DOCUMENTS

| | | | | | |
|---|---|---|---|---|---|
| 3,662,620 | A * | 5/1972 | Carlson | F16F 15/34 | 74/571.1 |
| RE30,703 | E * | 8/1981 | Paulson | A63B 69/406 | 124/1 |
| 4,679,860 | A * | 7/1987 | Koishi | B60B 23/10 | 301/29.2 |
| 4,989,657 | A * | 2/1991 | Lipper | B60B 25/04 | 301/9.1 |
| 5,127,390 | A * | 7/1992 | Paulson | A63B 69/406 | 124/78 |
| 5,464,208 | A * | 11/1995 | Pierce | A63B 69/406 | 124/78 |

(Continued)

*Primary Examiner* — John E Simms, Jr.
(74) *Attorney, Agent, or Firm* — Madson IP, P.C.

(57) ABSTRACT

A multifunctional pitching machine has one or more enhanced safety features such as a finger shield, a hub cap, a tilt-assist grip, and a ball chute with elbow and linear portions. The pitching machine has a drive motor connected to a mounting assembly, a wheel assembly attached to a drive shaft of the drive motor, and a support assembly that supports the mounting assembly. A ball chute assembly connects to a pinch pad positioning the ball chute to direct a ball through the ball chute to engage a gripping portion of the wheel assembly pinching the ball between the pinch pad and the gripping portion to impart a propelling force to the ball. The wheel assembly may be a large, uncovered pneumatic tire and cast hub secured to the drive shaft by a single locking nut. The cast hub may be two-pieced to facilitate easy removal and tire changes.

12 Claims, 14 Drawing Sheets

(56) References Cited

U.S. PATENT DOCUMENTS

| | | | | | |
|---|---|---|---|---|---|
| 5,707,113 | A * | 1/1998 | Russell | B60B 7/14 | 301/108.4 |
| 5,832,909 | A * | 11/1998 | Grant | A63B 69/406 | 124/6 |
| 6,402,640 | B1 * | 6/2002 | Stuart | A63B 69/406 | 124/78 |
| 9,623,313 | B1 * | 4/2017 | Boehner | A63B 69/406 | |
| 12,060,722 | B2 * | 8/2024 | Burk | B60B 37/04 | |
| 2009/0260612 | A1 * | 10/2009 | Grant | A63B 69/406 | 124/78 |
| 2009/0301452 | A1 * | 12/2009 | Lay | A63B 69/406 | 29/428 |
| 2014/0261362 | A1 * | 9/2014 | Boehner | A63B 69/406 | 124/78 |

* cited by examiner

UNCOVERED-WHEEL PITCHING MACHINE WITH CAST HUB AND SAFETY SHIELD

BACKGROUND OF THE INVENTION

1. Field of the Invention

The present invention relates to pitching machines, and more particularly, to an uncovered-wheel pitching machine with safety features that address long-known risks of bodily harm to those using uncovered-wheel pitching machines.

2. The Relevant Technology

In many sporting events players participate by pitching, hitting, and catching. During training, such players may practice within specialized enclosures such as batting cages, bullpen enclosures, and the like that are enclosed by netting or other confining materials. Pitching machines have been used for many years in a player practice setting and, in some leagues, where machine pitching is used for younger players. Although pitching machines are best known for batting practice, pitching machines that have tilting or rotating capability may be used for catching and fielding practice as well. Many pitching machines use a rotating wheel assembly to impart propelling force to balls being pitched. With some pitching machines the rotating wheel assemblies are enclosed within a housing that shields a user from unintentional encounters with the wheel. However, for many of the wheel assemblies (frequently involving larger diameter tires), particularly those using pneumatic tires requiring access to the valve stem, the wheel to which the tire is mounted is frequently a modified vehicle wheel that is uncovered, exposing a user to fast rotating parts of the wheel such as spokes, lug nuts, valve stems, balancing weights, metal cut-outs, and other protrusions. Pitching machines using this type of uncovered wheel assemblies, whether having solid or pneumatic tires, may pose a serious danger to persons or clothing becoming entangled with rapidly spinning machinery parts.

Consequently, there is a need for safety features for pitching machines that may eliminate or reduce wheel spinning dangers.

BRIEF SUMMARY OF THE INVENTION

The present invention has been developed in response to the present state of the art, and in response to the problems and needs in the art that have not yet been fully solved and are not currently available. The present invention provides a multifunctional pitching machine for propelling balls at predetermined release heights above the ground. The multifunctional pitching machine is enhanced with safety features and may be interchangeable between a baseball mode and a softball mode.

The pitching machine has a mounting assembly onto which a drive motor is connected, a wheel assembly, and a support assembly. The mounting assembly comprises a framework onto which other components, such as the drive motor and a housing may be connected. The drive motor may be connected directly or indirectly to the mounting assembly and/or, in some embodiments, the drive motor may be housed within a housing assembly or shielded, fully or partially by the housing assembly. The wheel assembly is uncovered (meaning that it is not enclosed within the housing assembly) and is attached to a drive shaft of the drive motor. The drive shaft conveys rotational force to rotate the wheel assembly at speeds selectable by a user. The mounting assembly may be supported by the support assembly. That support may be firmly affixed or may permit rotation of the mounting assembly and/or may permit tilting side to side and/or forward or backward.

In some embodiments, a tiltable connection of the mounting assembly may be a ball and socket type, for example, that permits the mounting assembly to be rotated and or tilted side to side and forward or backward (i.e., multidirectional tilting and rotation). In other embodiments, the tiltable connection may be limited to permitting the mounting assembly to tilt forward or backward thereby adjusting the vertical trajectory of balls being propelled from the pitching machine. With this embodiment, a tilt bracket, for example, may attach to the mounting assembly and the tilt bracket has a pivot axis bore and a curved slot on each bracket ear. To facilitate the tiltable connection, the support assembly has a base mount with an upright portion, aligning pivot axis bores in the upright portion through which a pivot axis pin passes and serves as a pivot axle when also passing through each pivot axis bore, and a tilt-selection fastener that passes through each curved slot that may be fastened to secure a tilt selection or loosened to permit a different tilt selection.

The mounting assembly also may have a pinch pad assembly anchor connected to the mounting assembly positioned to receive a pinch pad assembly. The pinch pad assembly may have a gooseneck structure with an anchoring end and a cantilevered end, and a pinch pad connected to the cantilevered end. The anchoring end may be secured to the pinch pad assembly anchor in a manner that provides for height adjustment that correlates with the height at which the pinch pad is spaced from a gripping portion of the wheel assembly.

Further, a ball chute assembly comprising a ball chute and a ball chute connector may be connected to the pinch pad or the pinch pad assembly in a manner that positions the ball chute such that a ball passing through the ball chute engages the wheel assembly to be pinched between the pinch pad and the wheel assembly. Such pinching of the ball and rotation of the wheel assembly imparts a propelling force to the ball.

A safety feature of the ball chute is that it has an elbow portion and a linear portion. The combination of the elbow portion and the linear portion inhibits a user from intentionally or unintentionally passing his/her hand through the ball chute, thereby keeping the hand a safe distance from the rotating wheel assembly.

In some embodiments, the wheel assembly has a pneumatic tire having a relatively large outer diameter (for example, greater than 14 inches including 17 inches). Typically, smaller pneumatic tires are enclosed (covered) within housing assemblies and do not pose a serious danger to persons or clothing becoming entangled with rapidly spinning machinery. In other embodiments, the wheel assembly may be machined or molded as one piece or may have a tire (solid or pneumatic) secured to a modified vehicle-type wheel. Although various types of uncovered wheel assemblies may be used with pitching machines, such wheel assemblies always have a gripping portion for grasping the ball to be propelled and a hub portion to connect the wheel assembly to the drive motor that imparts rotational spinning to the wheel assembly.

In another embodiment, the wheel assembly has a cast hub, and that cast hub may be secured to the drive shaft by a single locking nut. Heretofore, larger pneumatic tires have been mounted on vehicle-like wheels having dangerously exposed spokes, lug nuts, valve stems, balancing weights, metal cut-outs, and other protrusions that pose a serious danger to persons or clothing becoming entangled with rapidly spinning machinery. The cast hub, being cast for the specific pitching machine purpose, has eliminated, or reduced any danger as will be discussed herein below.

In some embodiments of the present invention, the pitching machine is enhanced with safety features that protect users from certain potential injuries while operating the pitching machine and/or from errant throws potentially dangerous to batters, fielders, or even onlookers. The pitching machine may be enhanced with one or more safety features such as a finger shield, a tilt-assist grip, a hub cap, a ball chute having an elbow portion and a linear portion, and a non-slip height adjustability of a pinch pad from the uncovered wheel assembly. The finger shield may be positioned proximate to and spaced from a hub portion of the uncovered wheel assembly creating a vicinity gap preventing fingers from passing into the vicinity gap between the finger shield and the hub portion of the uncovered wheel assembly. The tilt-assist grip may be connected to a pinch pad assembly that is connected to the mounting assembly so that the tilt-assist grip is graspable with one hand to stabilize and deter undesired tilting of the mounting assembly during tightening or loosening of a tiltable connection supporting the mounting assembly. The hub cap may be positioned to shield the hub portion of the uncovered wheel assembly by shielding at least some rotating portions of the wheel hub from undesired touching or from snagging loose clothing or jewelry. The ball chute may be configured to inhibit a person's hand from passing through the elbow portion and the linear portion to touch the gripping portion of a rotating uncovered wheel assembly. The non-slip height adjustability of a pinch pad of the pinch pad assembly maintains spacing between the pinch pad and the gripping portion of the uncovered wheel assembly so that pinching of the ball remains relatively uniform, thereby maintaining consistent spin and eliminating or significantly reducing errant throws from the pitching machine.

These and other features of the present invention will become more fully apparent from the following description or may be learned by the practice of the invention as set forth hereinafter.

BRIEF DESCRIPTION OF THE DRAWINGS

For the above-recited and other features and advantages of the invention to be readily understood, a more particular description of the invention briefly described above will be rendered by reference to specific embodiments thereof which are depicted or illustrated in the appended figures. Understanding that these depictions and drawings show only typical embodiments of the invention and should not be considered limiting of its scope, the invention will be described and explained with additional specificity and detail with reference to the accompanying figures in which:

FIG. 3A depicts the left side of the tiltable connection of the forward-facing multifunctional uncovered-wheel pitching machine, while FIG. 3B depicts the right side of the tiltable connection of the forward-facing multifunctional uncovered-wheel pitching machine.

FIG. 6B shows the anchoring end as inserted into the pinch pad assembly anchor and secured at a predetermined height to accommodate a specific size of ball.

Figure 1:
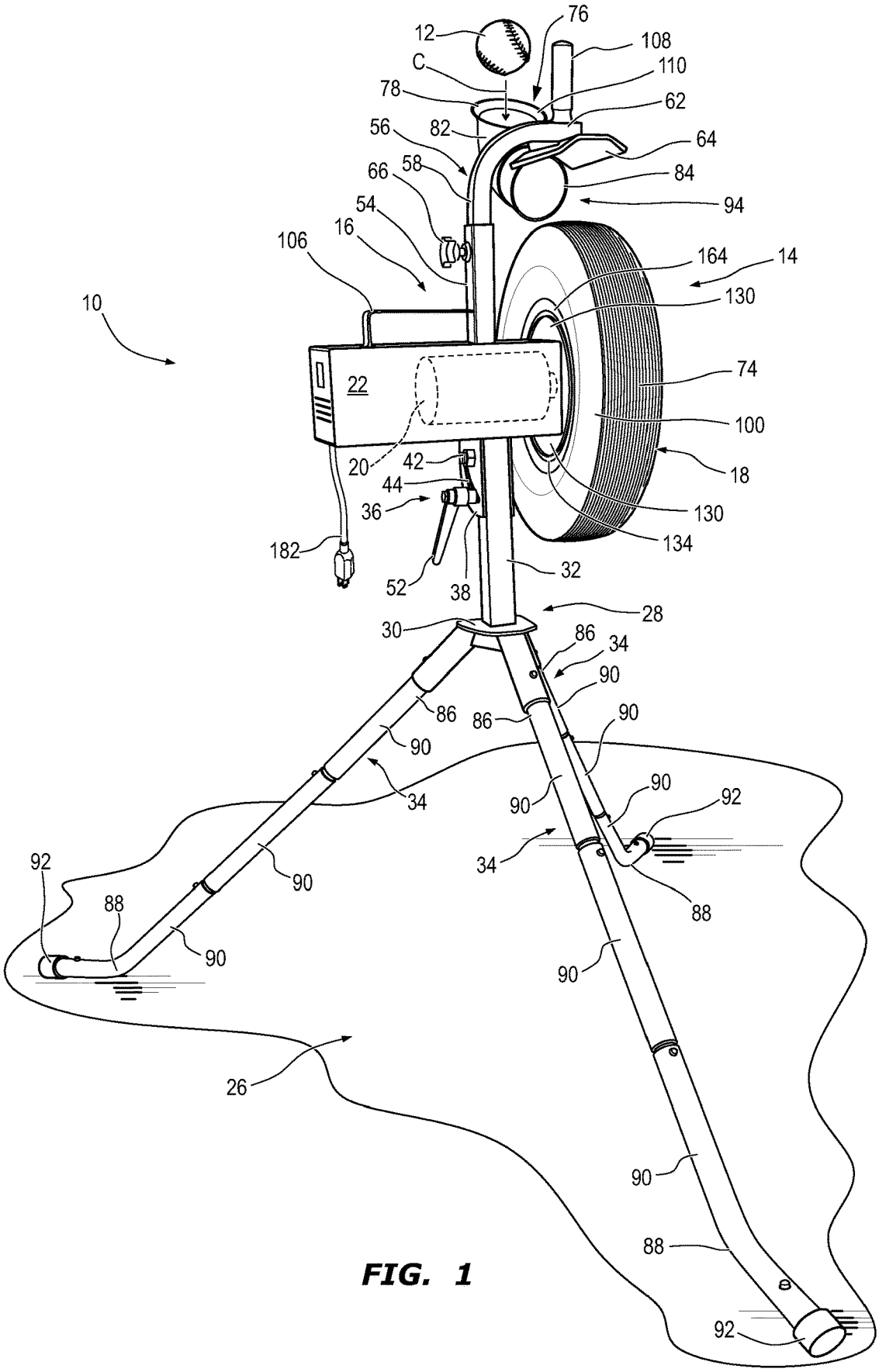
FIG. 1 is a perspective view of an exemplary embodiment of an uncovered-wheel pitching machine configured in a baseball mode.

REFERENCE NUMBERS multifunctional pitching machine 10
ball(s) (baseball, softball, etc.) 12
pitching machine 14
mounting assembly 16
wheel assembly 18
drive motor 20
housing assembly 22
drive shaft 24
ground (or support surface) 26
support assembly 28
base mount 30
upright portion 32
leg(s) 34
tiltable connection 36
tilt bracket 38
pivot axis bore(s) 40
pivot axis pin 42
curved slot(s) 44
bracket ear(s) 46
aligning pivot axis bore(s) 48
pivot axle 50
tilt-selection fastener 52
pinch pad assembly anchor 54
pinch pad assembly 56
gooseneck structure 58
anchoring end 60
cantilevered end 62
pinch pad 64
threaded adjustment knob 66
female threaded aperture 68
height-capturing bore(s) 70
height indicia 72
gripping portion 74
ball chute assembly 76
ball chute 78
ball chute connector 80
elbow portion 82
linear portion 84
straight end 86
angled end 88
leg section(s) 90
end boot 92
upper release height 94
lower release height 96
hub portion 98
tire 100
cast hub 102
locking nut 104
bracing handle 106
tilt-assist grip 108
flared lip 110
cantilevered tongue 112
securing assembly 114
ball feeder stub 116
fixed end 118
free end 120
aligning post(s) 122
post receiving bore(s) 124
ball chute knob 126
thread receiver 128
finger shield 130
circular periphery 132
vicinity gap 134
roll pin 136
obverse side 138
valve stem aperture 140
obverse central hub 142
obverse rim 144
obverse shoulder 146
recessed bolt head well(s) 148
bolt head(s) 150
washer 152
roll pin groove 154
concentric inner wall 156
reverse side 158
reverse central hub 160
reverse shoulder 162
reverse rim 164
recessed nut well(s) 166
threaded bolt shaft(s) 168
nut(s) 170
wheel-balancing blind hole(s) 172
circular wall(s) 174
rear side 176
control face 178
speed control knob 180
power cord 182
two-piece cast hub 184
obverse half 186
reverse half 188
inside face 190
bolt-bore abutments 192
central hub protrusion 194
central hub receptacle 196
hub cap 198
outer dome surface 200
concave underside 202
concentric ribs 204
attachment assembly 206
capturing enclosure 208
ball feeder 210
electrical cord 212
male plug 214
outlet 216
core 218
receiving cup 220
helical ramp 230
retaining wall 232 tilt-adjustable mounting hub 234
entry end 236
tiltable neck 238
hub head 240
tightening/loosening pivot pin assembly 242
vents 244
reset button 246
axis of rotation A
pivot axis B
Arrow C
Arrow D

DETAILED DESCRIPTION OF THE INVENTION

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the present invention, as represented in the Figure(s), is not intended to limit the scope of the invention, as claimed, but is merely representative of presently preferred embodiments of the invention.

The word "exemplary" is used exclusively herein to mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

FIG. 1 is a perspective view of an exemplary embodiment of a multifunctional pitching machine 10 configured in a baseball mode. The multifunctional pitching machine 10 has enhanced safety features and is interchangeable between a baseball mode (depicted in FIG. 1) and a softball mode (best shown in FIG. 5). The multifunctional pitching machine 10 is designed to propel balls 12 at predetermined release heights above the ground.

The multifunctional pitching machine 10 has a pitching machine 14 comprising a mounting assembly 16 and a wheel assembly 18. A drive motor 20 (shown in phantom lines, obscured from direct view by a housing assembly 22) is connected to the mounting assembly 16 and has a drive shaft 24. As depicted, the wheel assembly 18 is uncovered (i.e., it is not housed within the housing assembly 22) and is attached to the drive shaft 24 (not shown in FIG. 1, best seen in FIGS. 2, 8, 14, and 15) of the drive motor 20. The drive shaft 24 has an axis of rotation A and conveys rotational force to rotate the wheel assembly 18 about the axis of rotation A at varying speeds as selected by the user.

The mounting assembly 16 comprises a framework onto which other components, such as the drive motor 20 and housing assembly 22 may be connected. The drive motor 20 may be connected directly or indirectly to the mounting assembly 16 (e.g., the drive motor 20 may be connected directly to the framework of the mounting assembly 16 or it may be connected to the housing assembly 22 which is connected directly to the framework of the mounting assembly 16) and/or, in some embodiments, the drive motor 20 may be housed within the housing assembly 22 or shielded, fully or partially by the housing assembly 22. The mounting assembly 16 is supported above the ground 26 (or a support surface 26) by a support assembly 28.

Figure 2:
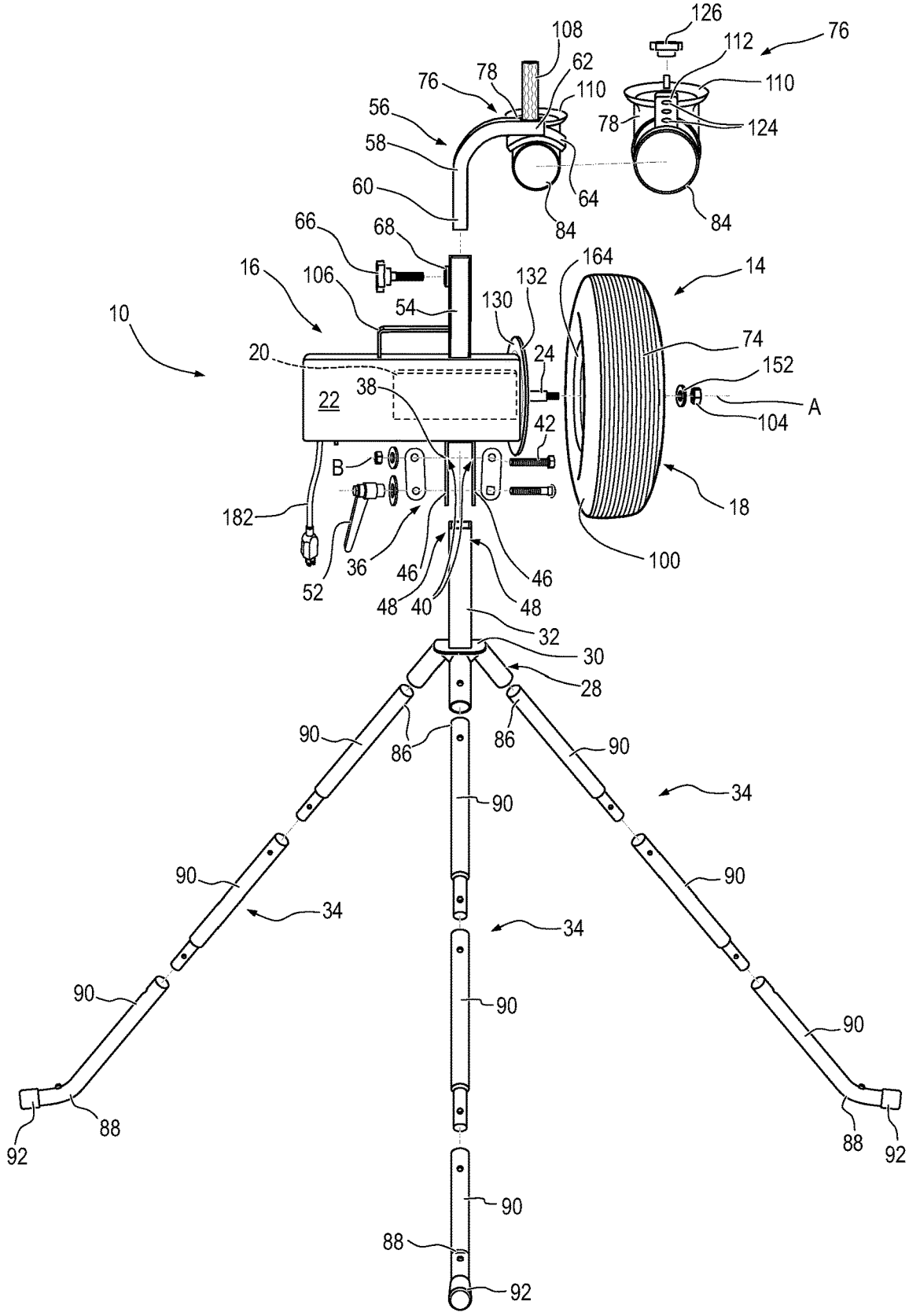
FIG. 2 is an exploded elevation view of the multifunctional uncovered-wheel pitching machine depicted in FIG. 1 showing the component parts used to assemble the baseball mode configuration.
Figure 3A:
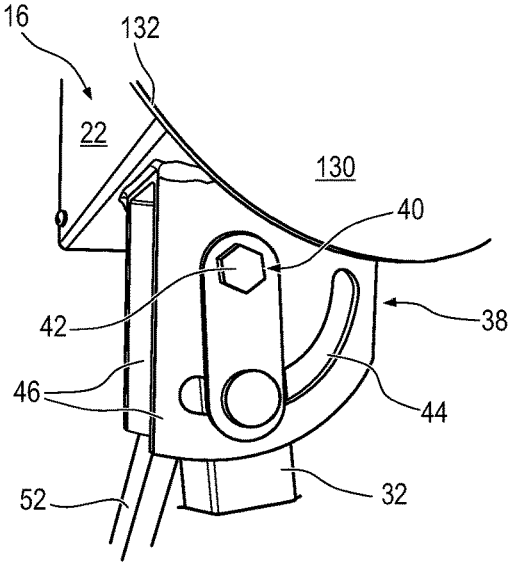
FIGS. 3A-B are perspective views of an exemplary tiltable connection for connecting a mounting assembly to a support assembly for the multifunctional uncovered-wheel pitching machine.
Figure 3B:
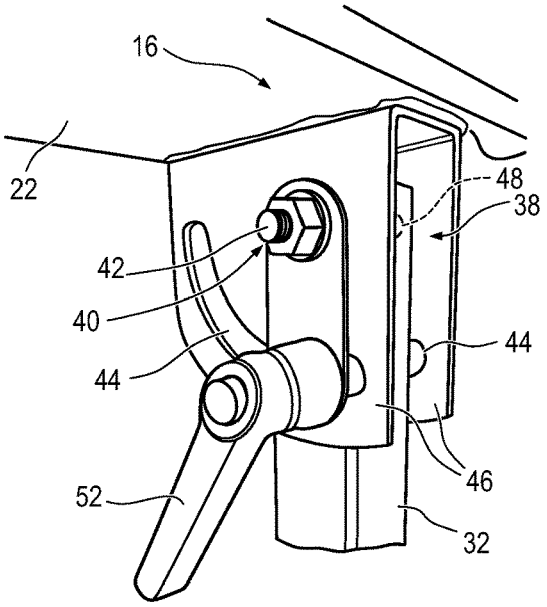

The support assembly 28 may be of any suitable type such as, by way of example and not to be limited to these examples, a tripod, a quadpod, a pedestal, a table, a platform, and any stable supporting structure, and may be modular (as depicted in FIGS. 1 and 2), or integrally formed. The exemplary support assembly 28 depicted throughout this disclosure has a base mount 30, an upright portion 32, and legs 34, however, those skilled in the art will understand that other types of supports may be used support the pitching machine 14.

An exemplary tiltable connection 36 of the mounting assembly 16 to the support assembly 28 permits the mounting assembly 16 to tilt forward or backward thereby adjusting the vertical trajectory of balls 12 being propelled from the pitching machine 14. Of course, many tilting mechanisms are known and have been used with pitching machines. Some tilt only in a vertical plane and others, like a ball and socket mechanism, tilt or swivel angled from the vertical plane and/or rotate directionally. Those skilled in the art, armed with this disclosure, will be able to adopt any of a number of tilting mechanisms to accomplish ball projection features desired, such as tilting to impart a spin on the ball to throw curves, drop balls, sliders, and the like or swiveling to spray ground balls about the infield or fly balls or line drives about the outfield for fielding practice.

As best shown in FIGS. 1, 2, 3A and 3B, the exemplary tiltable connection 36 may comprise a tilt bracket 38, for example, attached to the mounting assembly 16 wherein the tilt bracket 38 has a pivot axis bore 40 (not depicted because obscured by pivot axis pin 42, but location identified by reference number and pivot axis B) and a curved slot 44 on each bracket ear 46. To facilitate the tiltable connection 36, the base mount 30 of the support assembly 28 has upright portion 32, aligning pivot axis bores 48 in the upright portion 32 through which the pivot axis pin 42 passes and serves as a pivot axle 50 (shown in phantom lines in FIG. 4) when also passing through each pivot axis bore 40, and a tilt-selection fastener 52 that passes through each curved slot 44 that may be fastened to secure a tilt selection or loosened to permit a different tilt selection.

A pinch pad assembly anchor 54 may be connected to the mounting assembly 16 and positioned to receive a pinch pad assembly 56. As best shown in FIGS. 2, 6A, 6B, and 7, the pinch pad assembly 56 has a gooseneck structure 58 with an anchoring end 60 and a cantilevered end 62, and a pinch pad 64 connected to the cantilevered end 62. The anchoring end 60 may be inserted into (see Arrow D) and secured to the pinch pad assembly anchor 54 in any suitable manner.

Figure 6A:
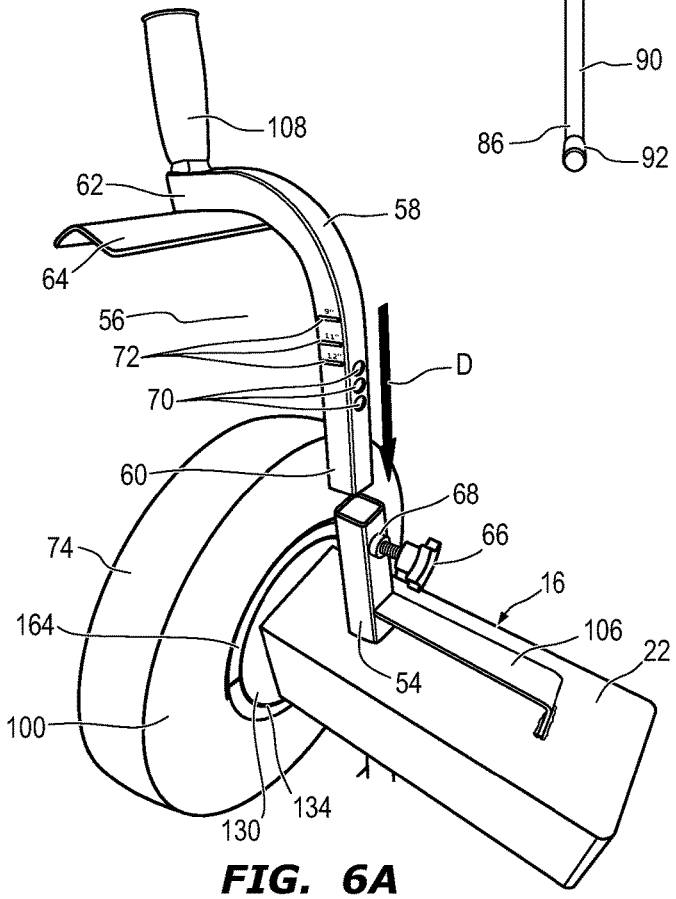
FIGS. 6A-B are prospective views of an exemplary pinch pad assembly that is adjustable to fit the size of the ball to be projected from the multifunctional uncovered-wheel pitching machine. As depicted in FIG. 6A, an anchoring end of a gooseneck structure of the pinch pad assembly is positioned for insertion into a pinch pad assembly anchor.
Figure 6B:
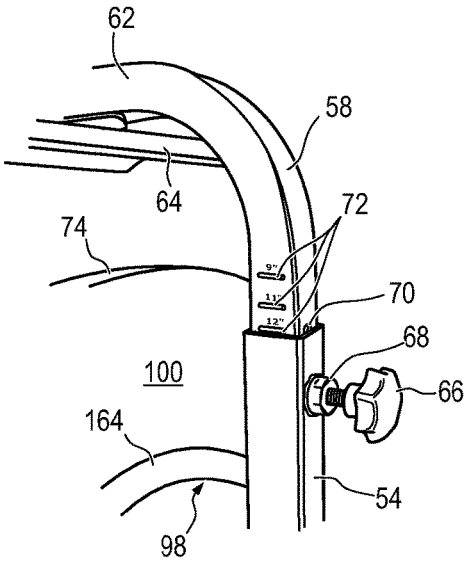

An exemplary manner of securing the anchoring end 60 to the pinch pad assembly anchor 56 utilizes a threaded adjustment knob 66 that threads through female threaded aperture 68 to engage height-capturing bores 70 in the anchoring end 60. By tightening or loosening the threaded adjustment knob 66, height adjustment of the pinch pad assembly 56 is provided. FIGS. 6A and 6B show height indicia 72 and height-capturing bores 70 that correlate with the height at which the pinch pad 64 is spaced from a gripping portion 74 of the wheel assembly 18. The height-capturing bores 70 secure the threaded adjustment knob 66 in a non-slip fashion by either being discrete bores or overlapping bores with sufficient circumferential wall to hold securely the anchoring end 60 at a predetermined height correlating to the predetermined spacing between the pinch pad 54 and the gripping portion 74 of wheel assembly 18 (without slippage as can occur if the height adjustment uses a slot into which the threaded adjustment knob 66 passes, thereby permitting infinite height adjustment between the ends of the slot). By maintaining spacing (without height slippage), the pinch on the ball 12 when passing between the pinch pad 64 and the gripping portion 74 of wheel assembly 18 remains relatively uniform, thereby maintaining consistent spin and eliminating or significantly reducing errant throws from the pitching machine 14.

Figure 7:
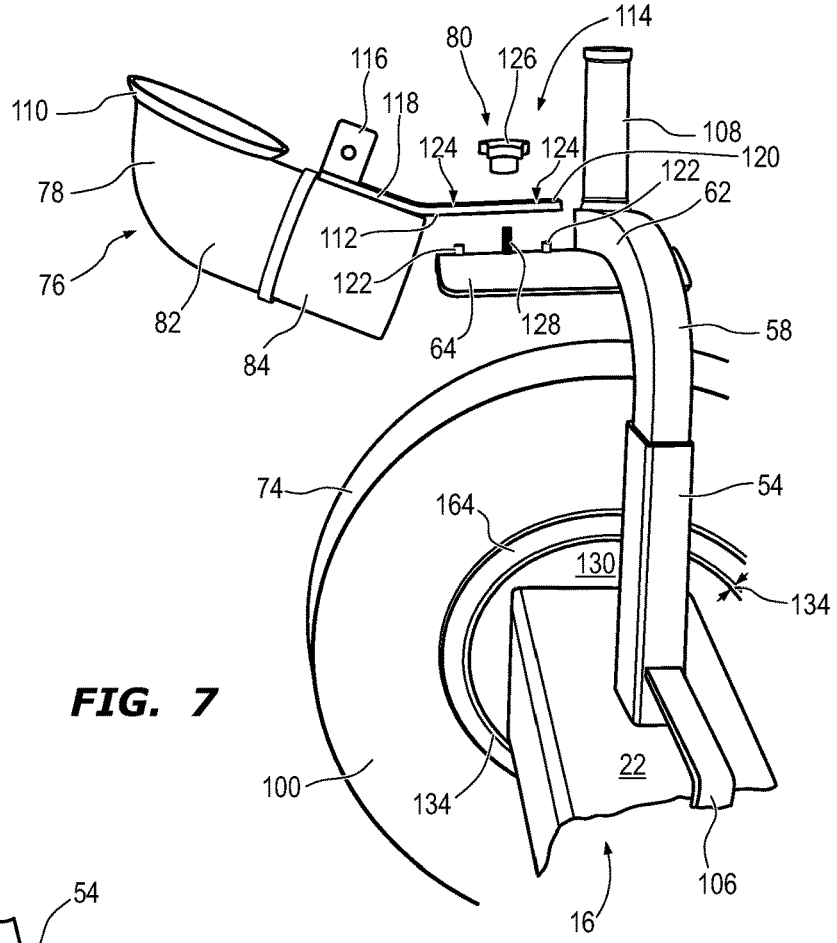
FIG. 7 is a perspective view of a portion of the multifunctional uncovered-wheel pitching machine with a ball chute assembly shown in an exploded view and positioned for connection to the pinch pad assembly.

A ball chute assembly 76 comprises a ball chute 78 and a ball chute connector 80 (see FIG. 7). The ball chute connector 80 connects to the pinch pad 64 and positions the ball chute 78 such that a ball 12 passing through the ball chute 78 engages the gripping portion 74 of the wheel assembly 18 in pinching engagement so that the ball 12 is pinched between the pinch pad 64 and the gripping portion 74 of wheel assembly 18 to impart a propelling force to the ball 12. The ball chute 78 comprises an elbow portion 82 and a linear portion 84.

Figure 4:
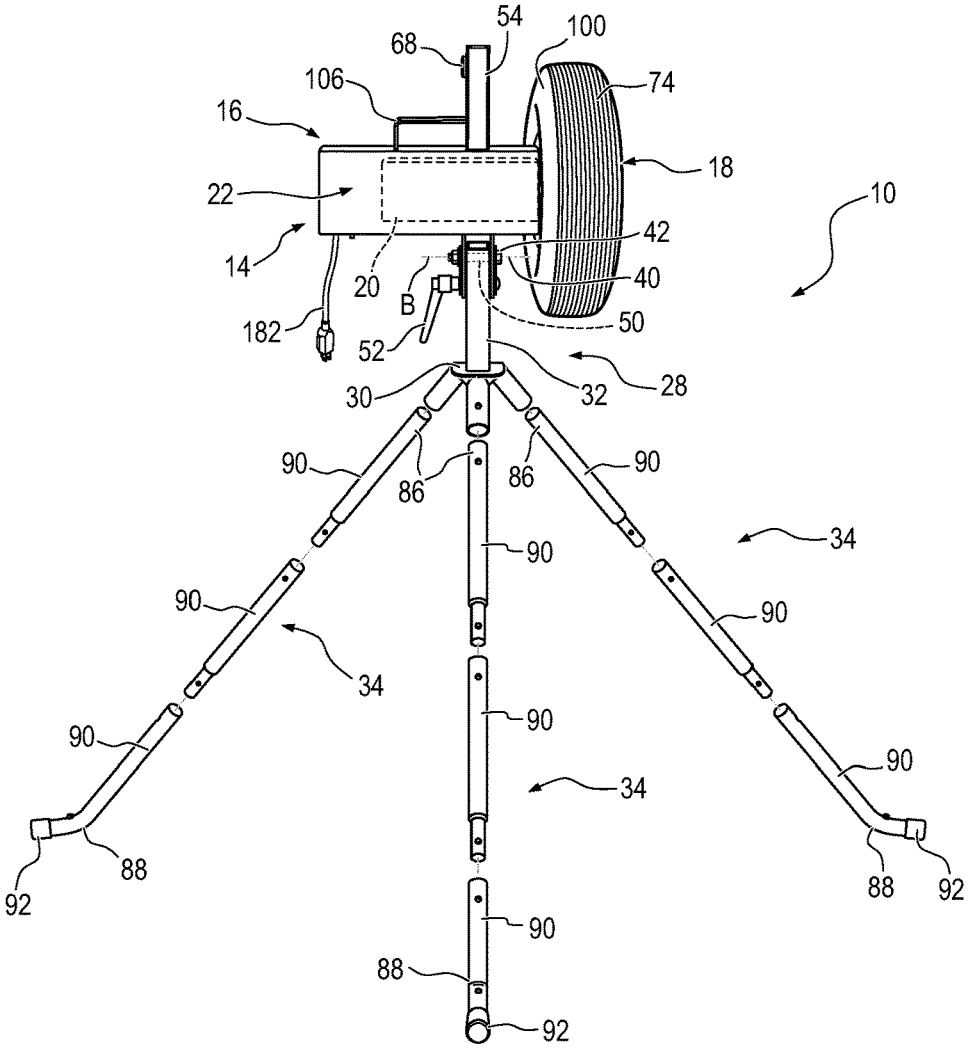
FIG. 4 is an elevational view of the multifunctional uncovered-wheel pitching machine of FIG. 1 showing an exemplary support assembly comprising a base mount, an upright portion, and legs configured as a tripod with leg sections shown in an exploded depiction, with one section for each leg having a bent configuration.
Figure 5:
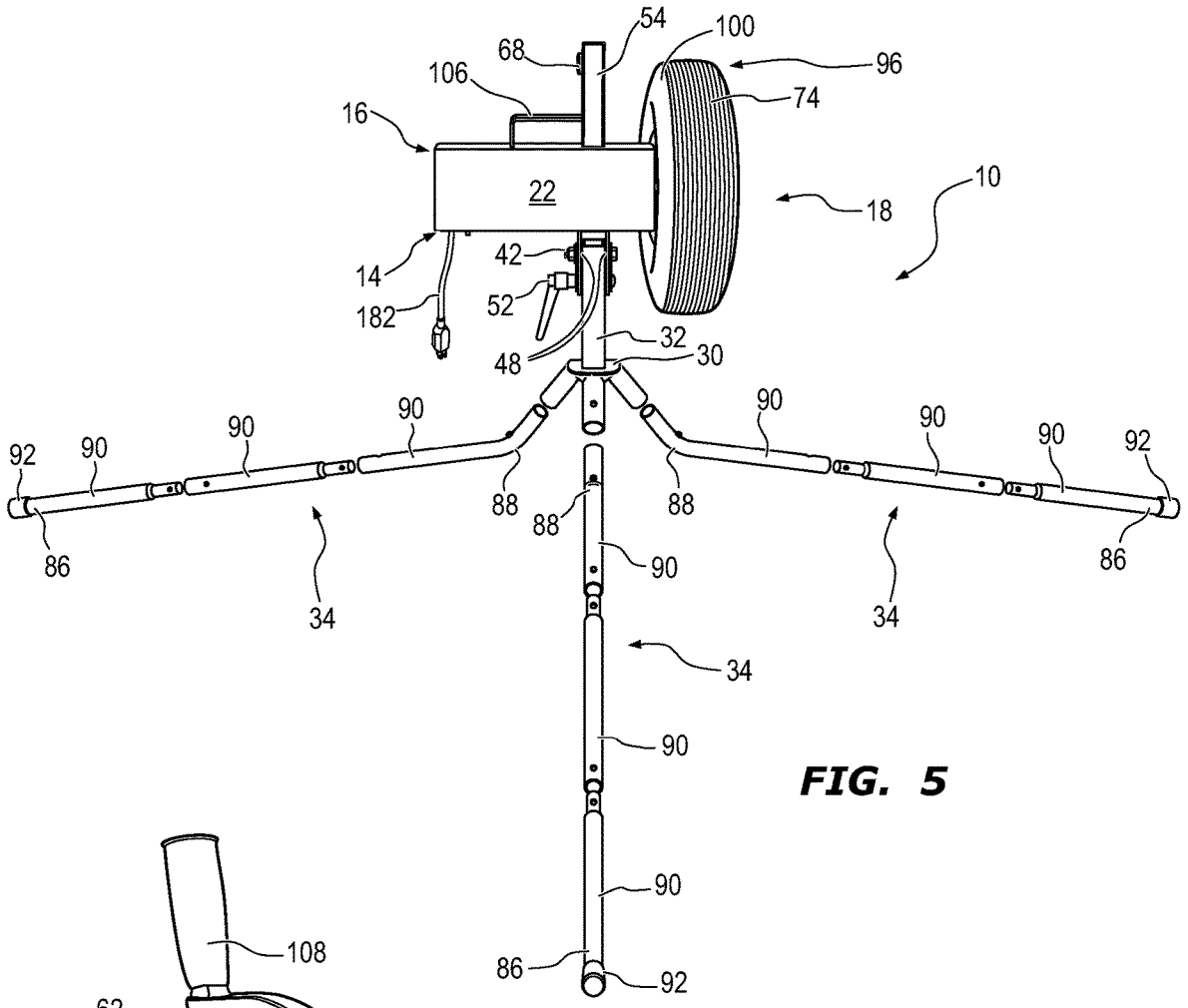
FIG. 5 is an elevational view of the multifunctional uncovered-wheel pitching machine configured in a softball mode showing the legs exploded and demonstrating that the same legs may be configured interchangeably between the baseball mode and the softball mode.
Figure 23:
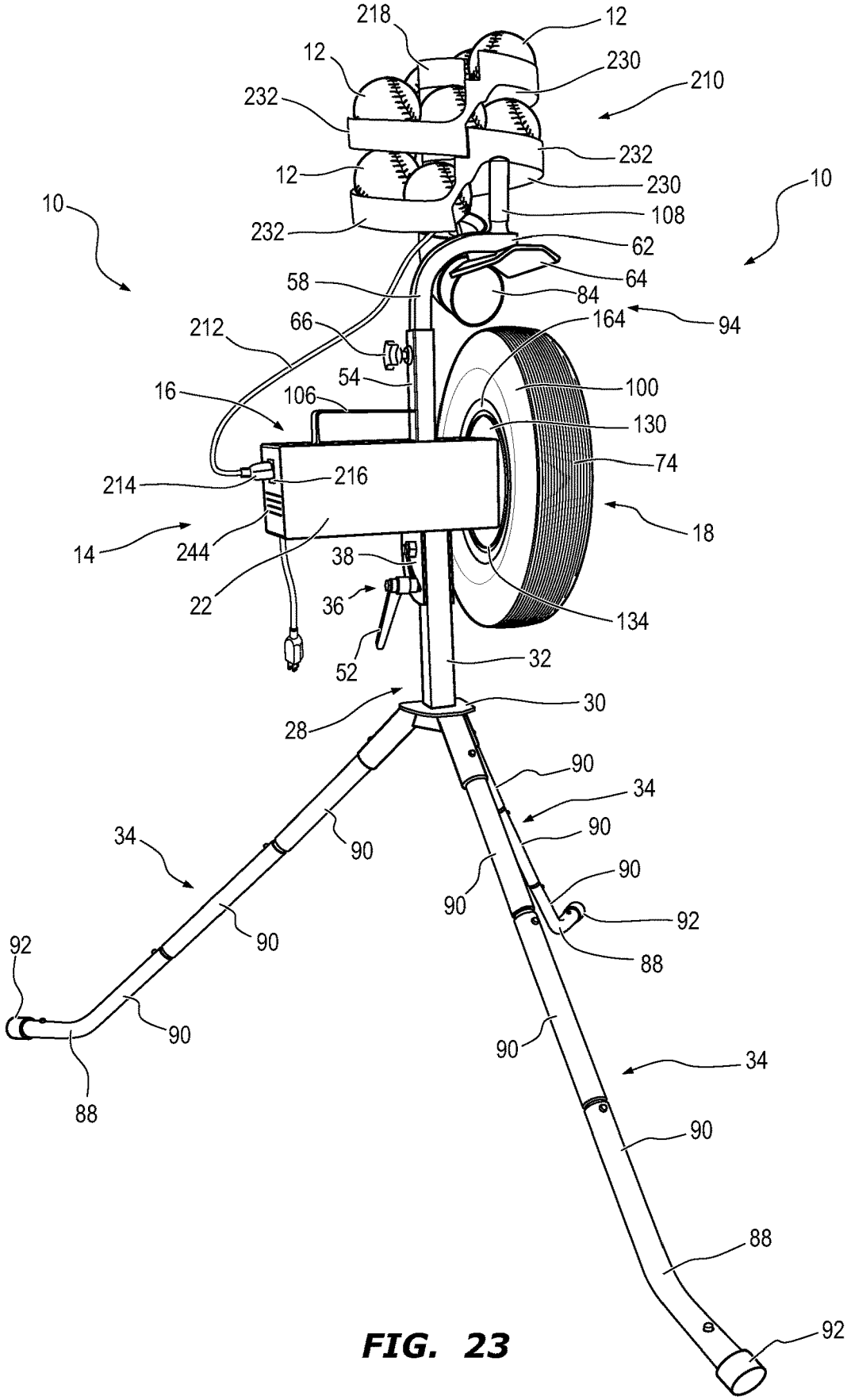
FIG. 23 is a perspective view of another exemplary embodiment of a multifunctional uncovered-wheel pitching machine with a ball feeder attached.

Turning now to FIGS. 1, 2, 4, and 5, and focusing on an exemplary embodiment of the support assembly 28, the support assembly 28 has at least three legs 34 each having a straight end 86 and an angled end 88. Although the FIGS. show the legs 34 divided into leg sections 90 with FIGS. 1 and 23 showing the legs 34 assembled and FIGS. 2, 4, and 5 showing legs 34 in exploded views, it should be understood that legs 34 may be formed unitary. Also, as depicted throughout, the legs 34 together with the base mount 30 form a tripod where it is preferred that the single leg 34 is disposed bracing forward and the other two legs 34 brace the pitching machine 14 against recoil when a ball 12 is propelled. However, the support assembly 28 may have more than three legs 34 or may have supporting structure not limited to legs 34 .

In an exemplary embodiment of the multifunctional pitching machine 10 that may be transitioned interchangeably between a baseball mode (see FIGS. 1 and 5) and a softball mode (see FIGS. 2 and 5), the straight end 86 and the angled end 88 of each leg 34 may be interchangeably connectable to the base mount 30 of the support assembly 28. To do so, end boot 92, that inhibits the leg 34 end from biting into the ground 26 and destabilizing the pitching machine 14, may be removed from the end of the leg 34 resting on the ground 26 and then replaced on the end of the leg 34 to be transitioned to rest on the ground 26. The support assembly 28 supports the pitching machine 14 so balls 12 are propelled at an upper release height 94 (as in the baseball mode) when the straight end 86 of each leg 34 is connected to the base mount 30 and the angled end 88 of each leg 34 engages the ground 26. In contrast, the support assembly 28 supports the pitching machine 14 so balls 12 are propelled at a lower release height 96 (as in the softball mode) when the angled end 88 of each leg 34 is connected to the base mount 30 and the straight end 86 (with the end boot 92 transferred and fitted thereon) of each leg 34 engages the ground 26.

Focusing now upon the wheel assembly 18, the wheel assembly 18 may be machined or molded as one piece or may have a tire (solid or pneumatic) secured to a modified vehicle-type wheel. Although various types of uncovered wheel assemblies 18 may be used with pitching machines 14, such wheel assemblies 18 always have a gripping portion 74 for grasping the ball to be propelled and a hub portion 98 to connect the wheel assembly 18 to the drive motor 20 that imparts rotational spinning to the wheel assembly 18.

Referring back to FIGS. 1 and 2, an exemplary embodiment of the wheel assembly 18 has gripping portion 74 and a hub portion 98. The exemplary wheel assembly 18 depicted further comprises a tire 100 with the gripping portion 74, which may be pneumatic or solid, and the hub portion 98 being a cast hub 102 that is secured to the drive shaft 24 by a single locking nut 104. The wheel assembly 18 is easy to disconnect to change the tire 100 and the cast hub 102 is easy to manufacture. The wheel assembly 18 will be discussed in more detail herein below.

Generally, FIG. 1 depicts the pitching machine 14 configured in a baseball mode wherein Arrow C shows the direction in which a ball 12 (baseball) may be inserted manually into the elbow portion 82 of ball chute 78. Also depicted is a bracing handle 106 connected to the housing assembly 22 (as connected to the mounting assembly 16) and bracing the pinch pad assembly anchor 54. The bracing handle 106 serves two principal purposes. First, it is a handle that may be grasped to transport the mounting assembly 20 if it is detached from the support assembly 28 and/or the pinch pad assembly 56. Second, the bracing handle 106 braces the pinch pad assembly anchor 54 against any lateral forces that may bend or deflect the pinch pad assembly anchor 54 causing the pinch pad 64 to lose its proper orientation and pinch spacing.

As depicted, the pinch pad assembly 56 is secured, using the threaded adjustment knob 66, at a height predetermined (designated by height indicia 72 shown best in FIGS. 6A & 6B) for propelling baseballs 12. Hence, baseballs 12 inserted into the elbow portion 82 of ball chute 78 will roll within and along the elbow portion 82 and then the linear portion 84 for delivery to be pinched between the pinch pad 64 and the gripping portion 74 of the wheel assembly 18 to be propelled (expelled from the pitching machine 14) at the upper release height 94. Because the depicted tiltable connection 36 is secured by the tilt-selection fastener 52 for horizontal forward expulsion, the baseball 12 will be propelled forward. Of course, tilt-selection fastener 52 may be loosened to permit the mounting assembly 16 to be tilted in a vertical plane upward for pop-ups or fly balls or downward for grounders or bad hops. To assist in the safe tilting of the mounting assembly 16, a tilt-assist grip 108 may be connected to the pinch pad assembly 56 that is connected to the mounting assembly 16. The tilt-assist grip 108 is graspable with one hand to stabilize and deter undesired tilting of the mounting assembly 16 during tightening or loosening of the tiltable connection 36 supporting the mounting assembly 16.

FIG. 7 is a perspective view of an exemplary ball chute assembly 76 shown in an exploded view and positioned for connection to the pinch pad assembly 56. Ball chute assembly 76 comprises the ball chute 78 and the ball chute connector 80. The ball chute 76 comprises the elbow portion 82 and the linear portion 84. The combination of the elbow portion 82 and the linear portion 84 inhibits a user from intentionally or unintentionally passing his/her hand through the ball chute 76, thereby keeping the hand a safe distance from the rotating wheel assembly 18. In some embodiments, the elbow portion 82 has a flared lip 110 that facilitates receipt of ball 12 into elbow portion 82 by funneling the ball 12 into the ball chute 76.

The ball chute connector 80 may be of any suitable type so long as the ball chute connector 80 aligns and secures the ball chute 76 to deliver the ball 12 for proper pinching engagement between the pinch pad 64 and the gripping portion 74. In one exemplary embodiment of the ball chute connector 80, the ball chute connector 80 comprises a cantilevered tongue 112 and a securing assembly 114 and may also have a ball feeder stub 116. A fixed end 118 of cantilevered tongue 112 is secured to the ball chute 76 while a free end 120 is connectable to the pinch pad assembly 56. Although any suitable securing assembly 114 may be used, an exemplary securing assembly 114, as depicted in FIG. 7, comprises aligning posts 122 and post receiving bores 124

Figure 24:
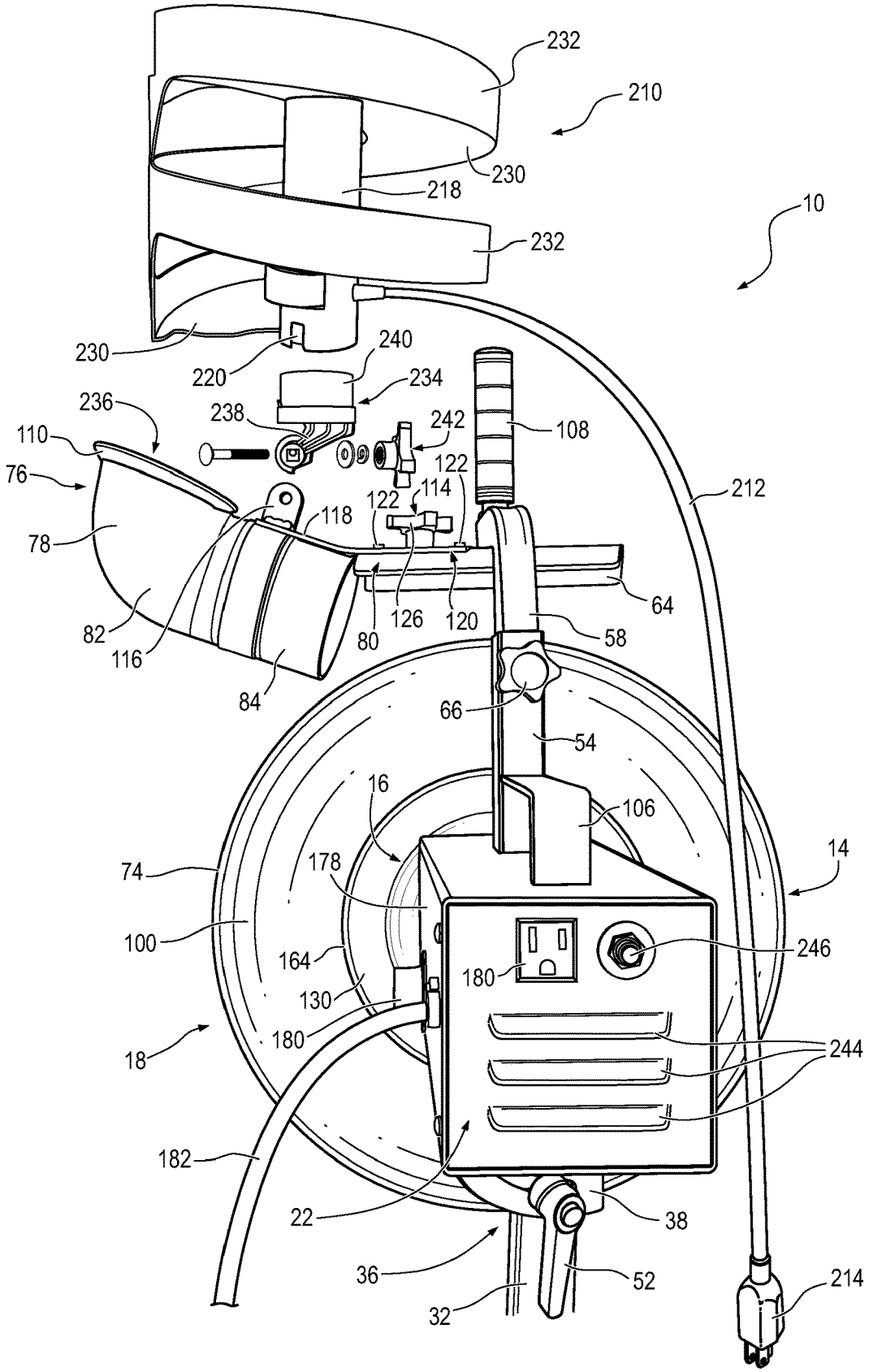
FIG. 24 is a side view of the exemplary multifunctional uncovered-wheel pitching machine of FIG. 23 with the attachable ball feeder shown exploded to illustrate the attachment.

(not shown but location identified by arrowed lead lines in FIGS. 7 and 24) positioned to assure that the proper alignment of the ball chute 76 is maintained, and a threadable ball chute knob 126 and a thread receiver 128 that clamps the free end 120 firmly against the pinch pad assembly 56. While FIGS. 7 and 24 show the aligning posts 122 connected to the pinch pad assembly 56 and the post receiving bores 124 in the free end 120 of the cantilevered tongue 112, the reverse construction may also be used; namely, the aligning posts 122 may be connected to the free end 120 of the cantilevered tongue 112 and the post receiving bores 124 may be located on the pinch pad assembly 56. Also, where FIG. 7 depicts the ball chute knob 126 to suggest it having female threads and the thread receiver 128 as a male threaded shaft connected to the pinch pad assembly 56, the reverse could also be used. The ball chute knob 126 could have male threads and the thread receiver 128 could be disposed on or in the pinch pad assembly 56 having female threads.

When the ball chute connector 80 is secured to the pinch pad assembly 56 (or to the pinch pad 64 specifically), the ball chute 78 is cantilevered from the pinch pad assembly 56, in some embodiments.

Figure 8:
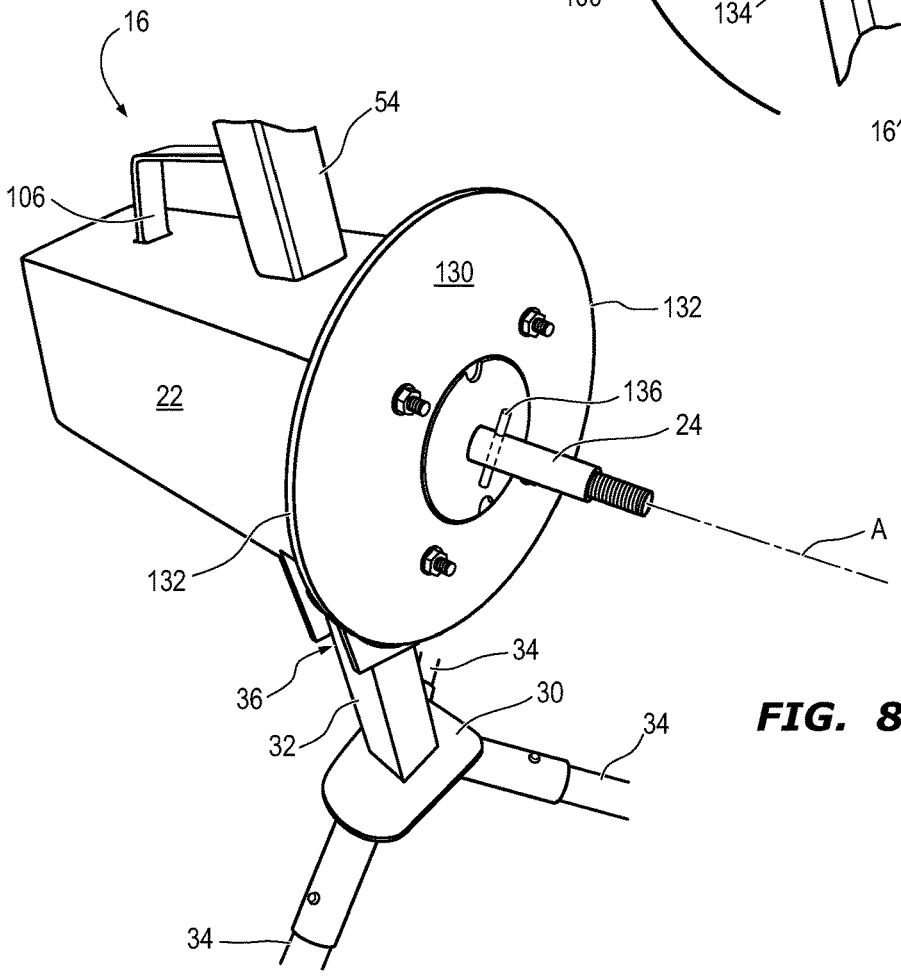
FIG. 8 is a perspective view of an exemplary mounting assembly and housing assembly of the multifunctional uncovered-wheel pitching machine with the wheel assembly removed to better show the wheel facing side of a finger shield and the drive shaft.

An exemplary mounting assembly 16, as depicted in FIG. 8, has an exemplary housing assembly 22 (housing and obscuring drive motor 20 from view) illustrates the wheel assembly 18 removed to better show the wheel facing side of a finger shield 130 and the drive shaft 24. The finger shield 130 may be connected to the mounting assembly 16 directly or indirectly. For example, the finger shield 130 may be connected to the housing assembly 22 which is connected directly or indirectly to the mounting assembly 16.

The finger shield 130 has a circular periphery 132 and a diameter that accommodates the diameter of the hub portion 98 in a manner that creates a vicinity gap 134 to prevent fingers from accessing the small space between the wheel assembly 18 and the circular periphery 132 of the finger shield 130 while the wheel assembly 18 may rotate freely spaced from the finger shield 130, as will be described in more detail below.

The drive shaft 24 conveys rotational force derived from the drive motor to rotate the wheel assembly 18. The drive shaft 24 may optionally comprise one or more roll pins 136 (one is depicted in FIG. 8) positioned to pass through the drive shaft 24 transversely to seat against the hub portion 98 to secure the delivery of rotational force to rotate the wheel assembly 18 by preventing the drive shaft 24 from spinning within the hub portion 98 of the wheel assembly 18. Additionally, as best shown in FIG. 2, the hub portion 98 is secured to the drive shaft 24 by a single locking nut 104.

Figure 9:
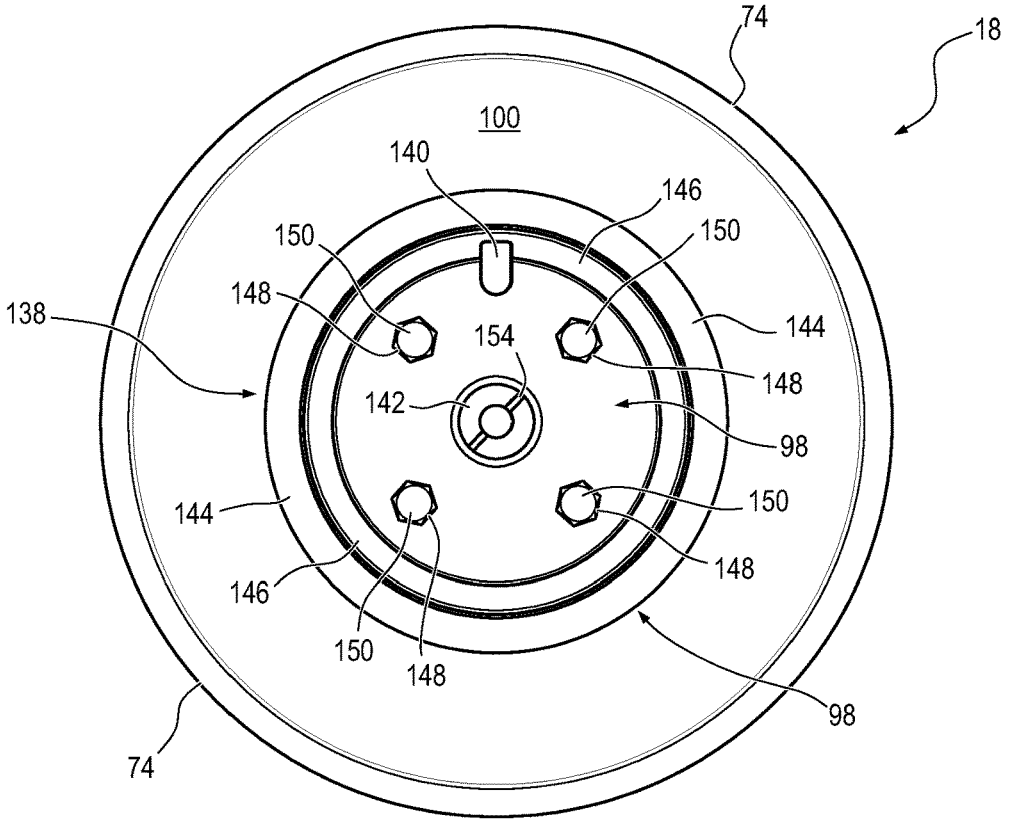
FIG. 9 is a side view of an exemplary wheel assembly showing the obverse side of the wheel assembly.
Figure 10:
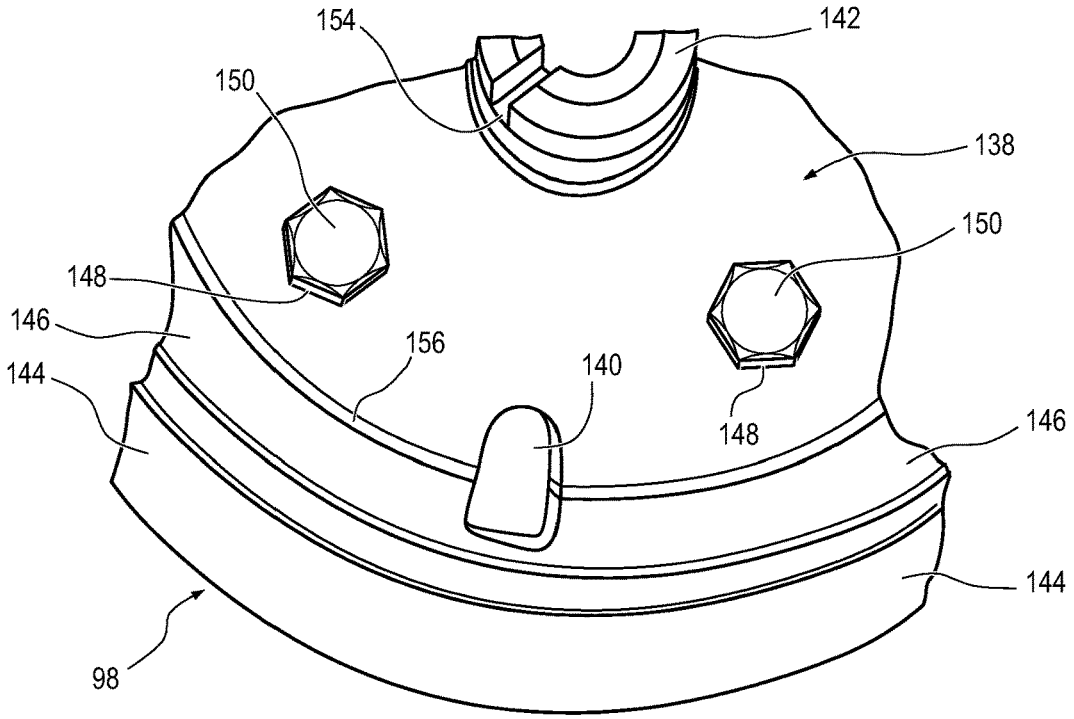
FIG. 10 is an enlarged view of a cut-away portion of the obverse side of the wheel assembly showing a valve stem aperture, a central hub, recessed bolt head wells, and bolt heads seated within the recessed bolt head wells.

FIGS. 9-15 are directed to exemplary embodiments and views of the wheel assembly 18. FIG. 9 is a side view of an exemplary wheel assembly 18 showing the obverse side 138 of the wheel assembly 18 having a tire 100, while FIG. 10 is an enlarged cut-away view of a portion of the obverse side 138 of an exemplary hub portion 98 of wheel assembly 18 with the tire 100 removed showing a valve stem aperture 140, an obverse central hub 142, an obverse rim 144, an obverse shoulder 146, recessed bolt head wells 148, and bolt heads 150 seated within the recessed bolt head wells 148, as well as the hub portion 98 of the wheel assembly 18.

The exemplary wheel assembly 18 depicted in FIG. 9 shows the tire 100, which may be pneumatic or solid, with the gripping portion 74. The hub portion 98 depicted on FIGS. 9 and 10 shows an exemplary cast hub 102 that may be secured to the drive shaft 24 by a single locking nut 104. Because the wheel assembly 18 is uncovered, the obverse side 138 of the wheel assembly 18 is exposed. Consequently, the cast hub 102 rotates during operation of the pitching machine 14 exposing the features listed above to spin rapidly. To reduce the dangers of such rapid spinning, the cast hub 102 is made to maximize smooth surfaces. With the obverse central hub 142, when secured by washer 152 (shown in FIGS. 2 & 15) and locking nut 104, any roll pin groove 154, if any, disposed to receive the roll pin 136 is covered making the obverse central hub 142 less likely to cause serious damage or injury. Because the cast hub 102 is secured to the drive shaft 24 by a single locking nut 104, the bolt heads 150 need not be accessed to remove and change the tire 100. Unlike wheel assemblies made from vehicle-type wheels that require removal of multiple lug nuts or bolt nuts from the obverse side to change a tire. In the exemplary embodiment shown, the bolt heads 150 are seated within the recessed bolt head wells 148 to present the combinations to be as close to flush surfaces as possible. Additionally, if the cast hub 102 is unitary rather than being two-pieced (described in detail below), the cast hub 102 may not require bolt heads 150 or recessed bolt head wells 148.

If the tire 100 is pneumatic and requires a valve stem, the valve stem typically needs to be accessible from the obverse side 138 so that the tire may be inflated or deflated without needing to remove the wheel assembly 18. Consequently, the valve stem aperture 140 is disposed on the obverse side 138 of the hub portion 98. Making the valve stem aperture 140 straddle the obverse shoulder 146 and its concentric inner wall 156, as shown in FIG. 10, access to the valve stem may be maximized by retrieving the valve stem through the portion of the valve stem aperture 140 in the concentric inner wall 156 of the obverse shoulder 138 while minimizing spinning dangers because the valve stem typically will plug most of the valve stem aperture 140.

Figure 11:
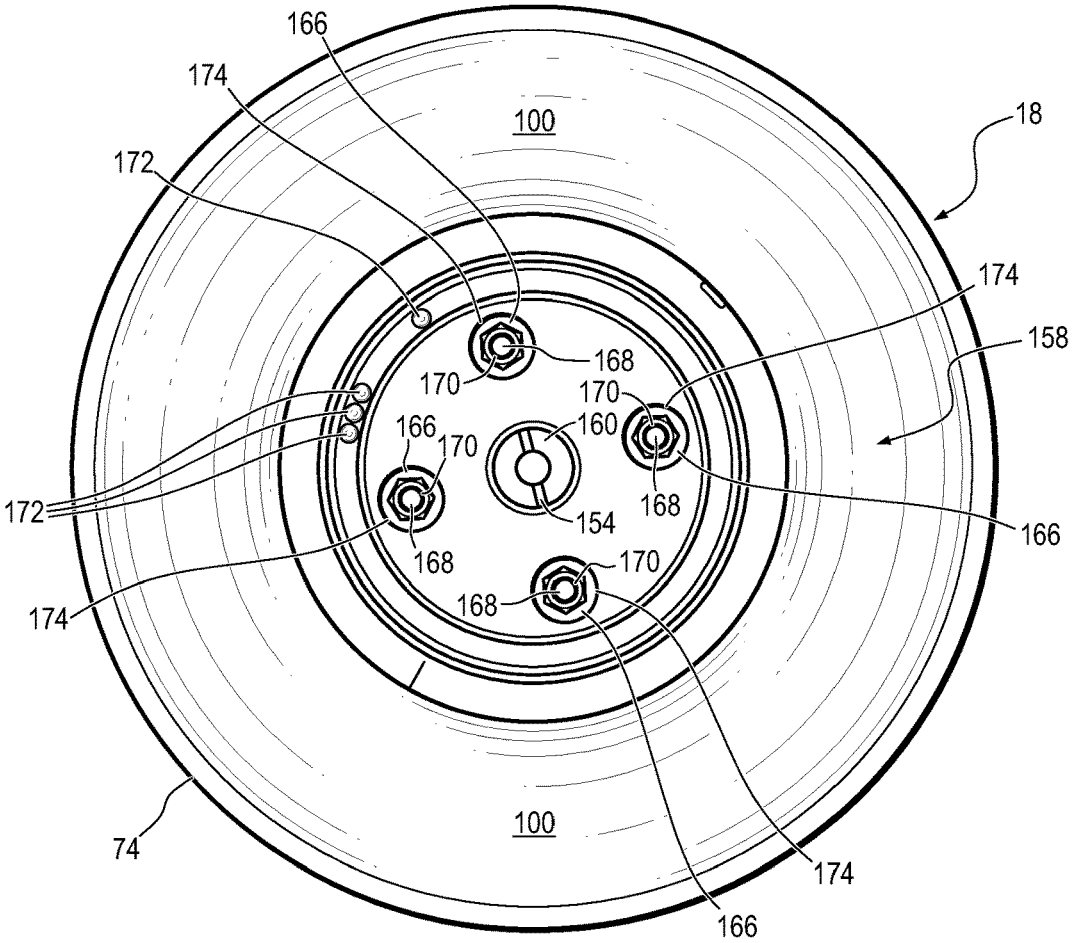
FIG. 11 is a side view of the exemplary wheel assembly of FIG. 9 showing the reverse side of the wheel assembly.
Figure 12:
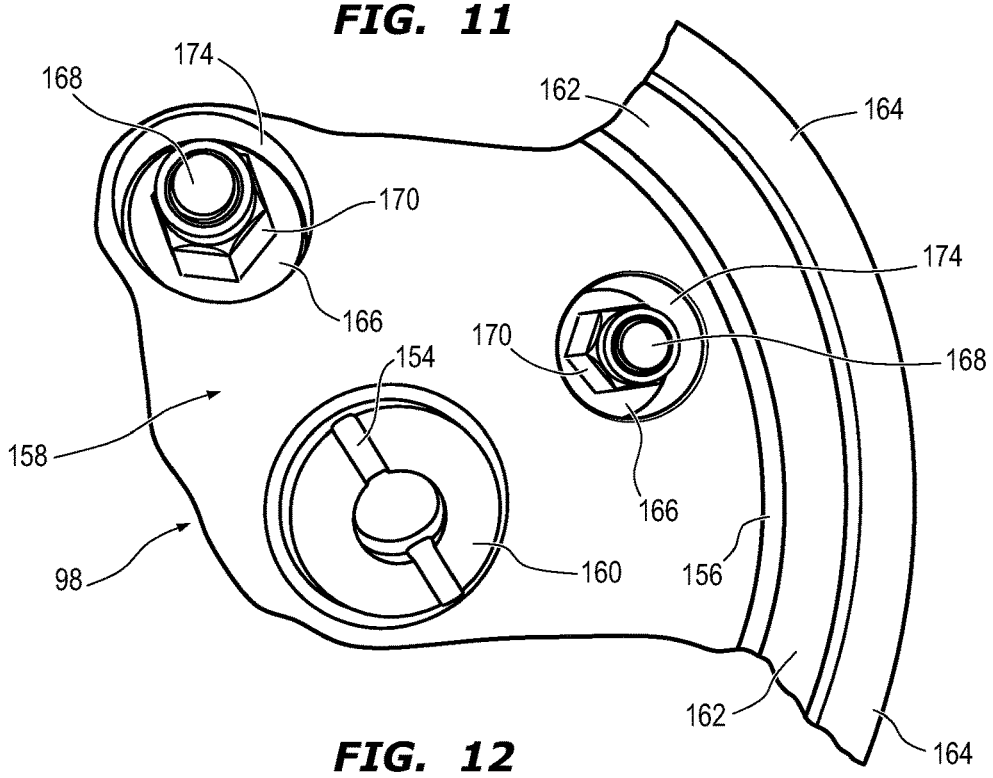
FIG. 12 is an enlarged view of a cut-away portion of the reverse side of the wheel assembly showing the hub, recessed nut wells, threaded bolt shafts, and nuts secured to the threaded bolt shafts and nested within the recessed nut wells.
Figure 13:
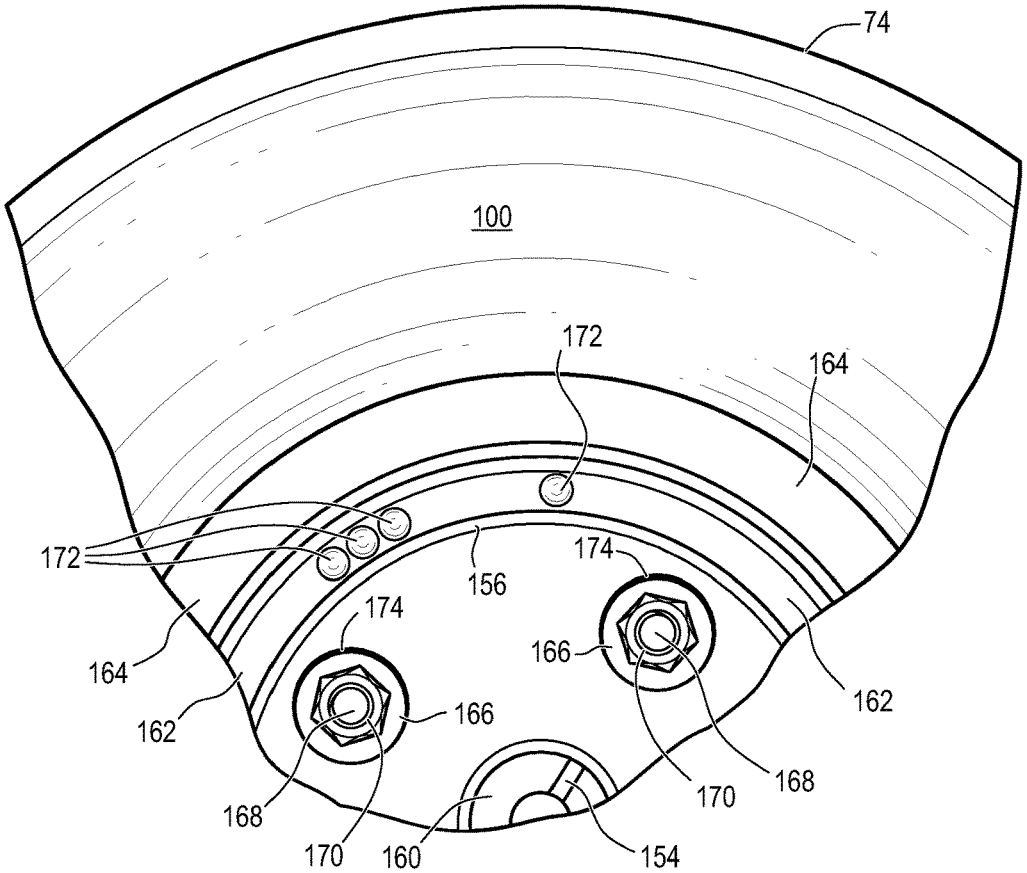
FIG. 13 is an enlarged view of another cut-away portion of the reverse side of the wheel assembly showing the gripping portion, the tire, the hub portion, a central hub, recessed nut wells, threaded bolt shafts, nuts secured to the threaded bolt shafts and nested within the recessed nut wells, and wheel-balancing blind holes.

FIG. 11 is a side view of the exemplary wheel assembly 18 of FIG. 9 showing the reverse side 158 of the wheel assembly 18, while FIGS. 12 and 13 are enlarged cut-away views of different portions of the reverse side 158 of the hub portion 98 of wheel assembly 18. FIG. 12 depicts the reverse side 158 of wheel assembly 18 showing a reverse central hub 160, a reverse shoulder 162, a reverse rim 164, recessed nut wells 166, threaded bolt shafts 168, and nuts 170 secured to the threaded bolt shafts 168 and nested within the recessed nut wells 166. As depicted in FIG. 13, the wheel assembly 18 shows the tire 100 with gripping portion 74 and hub portion 98 having wheel-balancing blind holes 172 in addition to the reverse central hub 160, recessed nut wells 166, threaded bolt shafts 168, and nuts 170 secured to the threaded bolt shafts 168 and nested within the recessed nut wells 166.

Because the reverse side 158 will be shielded from inadvertent touching or material snagging by the finger shield 130 (as will be discussed in detail below), the maximizing smooth surfaces as done on the obverse side 138 is not as important for the reverse side 158. For example, the recessed nut wells 166 do not fit snuggly about the nuts 170, rather they may have circular walls 174 spaced from the nuts 170 so that a standard socket wrench may be used to tighten or loosen the nuts 170. Similarly, the roll pin groove 154 need not be covered with a washer, for example, because it will not be exposed.

Further, the wheel-balancing blind holes 172 will not be exposed. Unlike wheel-balancing weights that typically are added to the rims of vehicle-type wheels for spin balancing by attaching one or more such wheel-balancing weights either to the obverse or reverse side rims or both, and present a dangerous rapidly rotating protrusion from the rim(s), the wheel-balancing blind holes 172 differ in that the spin balancing is accomplished by removing weight mass and creating blind holes that may be fine-tuned by varying the depths of the wheel-balancing blind holes 172 and may be covered to shield against inadvertent touching or apparel/accessory snagging.

Figure 14:
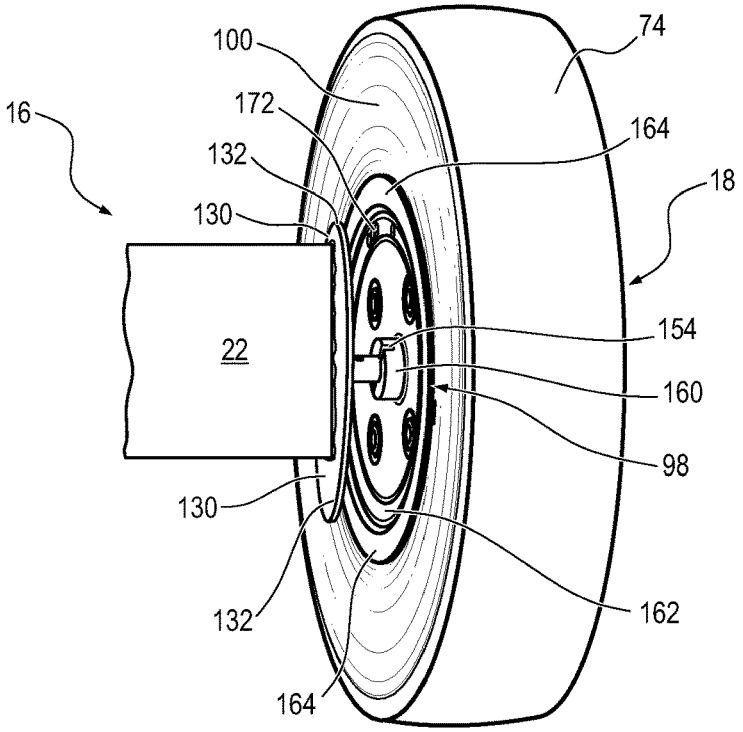
FIG. 14 is a perspective view of a portion of the multifunctional uncovered-wheel pitching machine showing the wheel assembly unsecured and spaced from the finger shield to reveal the reverse side of the wheel assembly.

FIG. 14 is a perspective view of a portion of the uncovered-wheel pitching machine 14 showing the wheel assembly 18 unsecured and spaced from the finger shield 130 to reveal the reverse side 158 of the wheel assembly 18 and to illustrate the juxtaposition of the finger shield 130 to the hub portion 98. As depicted, this view may represent a snapshot during the removal of the wheel assembly 18 from the drive shaft 24 or during the installation of the wheel assembly 18 onto the drive shaft 24. This depiction also shows that the circular periphery 132 of the finger shield 130 will fit within the open space inside the reverse rim 164 to form the vicinity gap 134.

Figure 15:
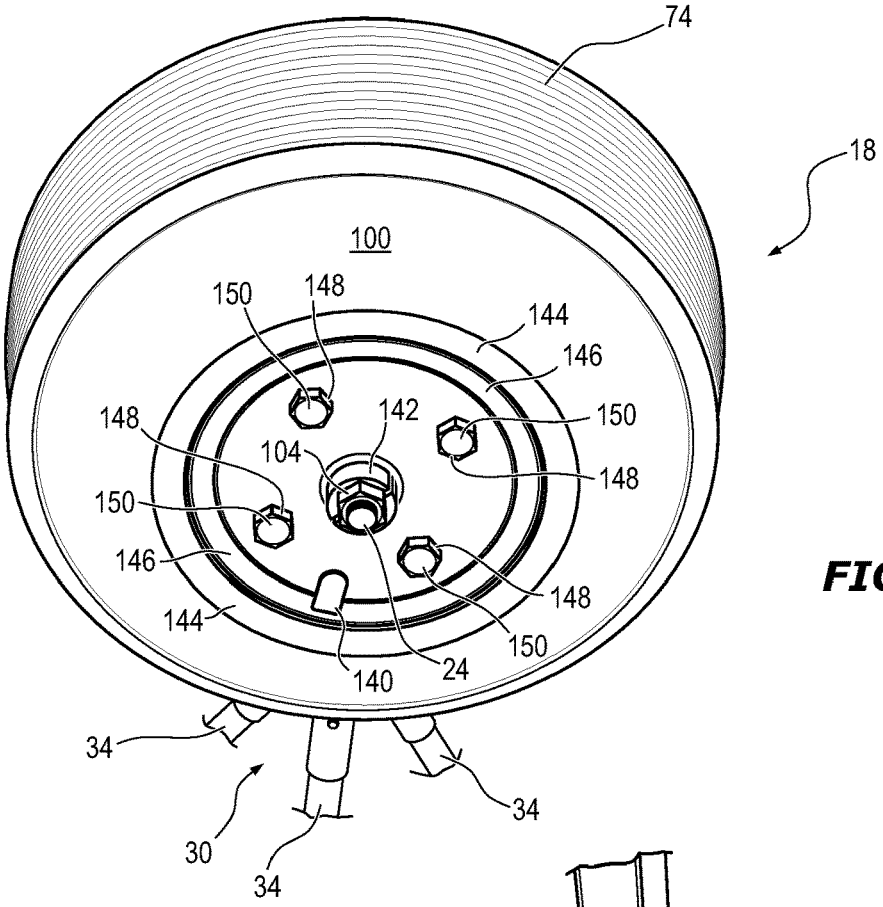
FIG. 15 is a perspective view the obverse side of the wheel assembly as secured to the drive shaft by a single locking nut.

The perspective view of the obverse side 138 of the wheel assembly 18 depicted in FIG. 15 shows the wheel assembly 18 secured to drive shaft 24 by a single locking nut 104. This enables the wheel assembly 18 to be disconnected from the drive shaft 24 by loosening the single locking nut 104.

Figure 16:
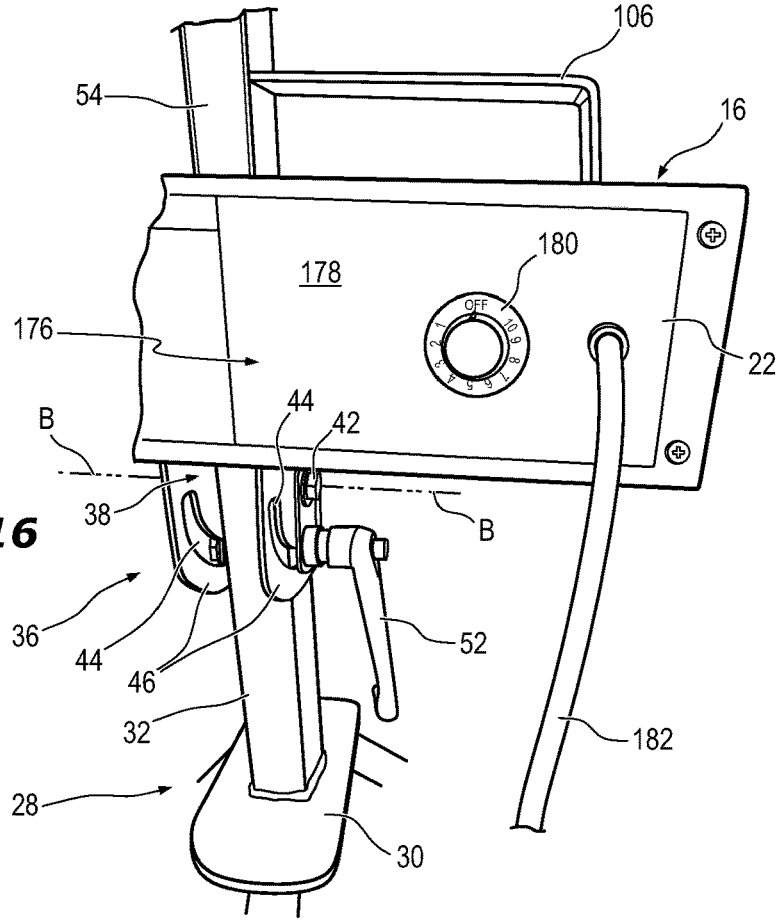
FIG. 16 is a perspective view of the rear side of the housing assembly of the mounting assembly showing the control face and speed control knob.

FIG. 16 is a perspective view of the rear side 176 of an exemplary housing assembly 22 of the mounting assembly 16 showing a control face 178 with a speed control knob 180 and power cord 182. Additionally, the control face may have other controls, digital display screens, operation-related indicia, and other inputs or outputs, and the like so that a user/operator of the pitching machine 14 may operate the pitching machine 14 from a safe location rearward of where balls 12 are propelled and within comfortable arm's reach of various components and features, for example, the ball chute 78 (not shown in FIG. 16), the tilt-selection fastener 52, the tilt-assist grip 108, and the speed control knob 180.

Figure 17:
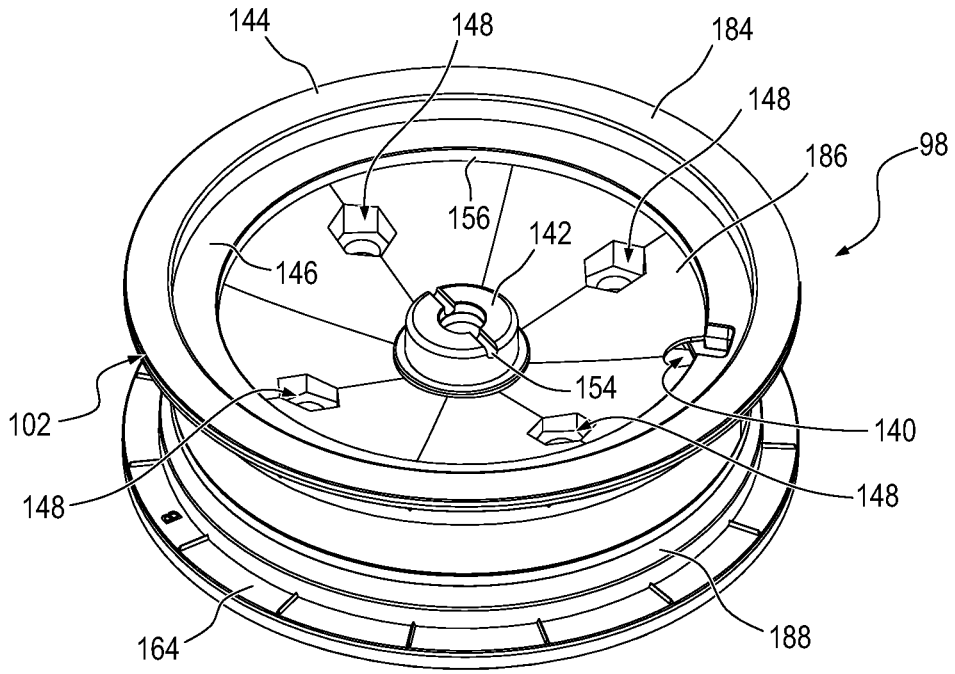
FIG. 17 is a perspective view of the obverse side of a two-piece cast hub showing recessed bolt head wells, a valve stem aperture, an obverse rim, an obverse shoulder, and an obverse central hub.
Figure 18:
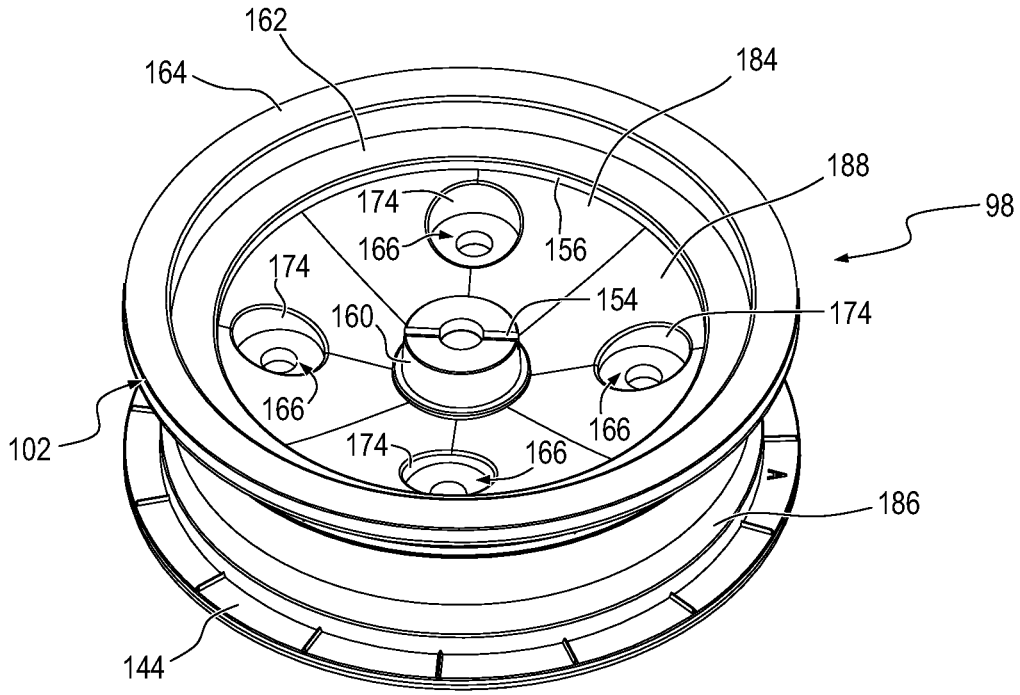
FIG. 18 is a perspective view of the reverse side of a two-piece cast hub showing recessed nut wells, a reverse rim, a reverse shoulder, and a reverse central hub.

FIGS. 17-20 depict components and the assembly of a representative exemplary embodiment of a two-piece cast hub 184. FIG. 17 depicts the obverse side 138 of the two-piece cast hub 184 showing recessed bolt head wells 148, the valve stem aperture 140, the obverse rim 144, the obverse shoulder 146, and the obverse central hub 142. FIG. 18 depicts the reverse side 158 of the two-piece cast hub 184 showing recessed nut wells 166, the reverse rim 164, the reverse shoulder 162, and the reverse central hub 160. The two-piece cast hub 184 makes changing tires 100, whether solid or pneumatic, particularly efficient, and easy to perform because securing the tire 100 to the two-piece cast hub 184 does not require a tire changing machine to stretch the tire beads over the rims to position the tire 100 within the rims 144, 164.

To change the tire 100 using the two-piece cast hub 184, the wheel assembly 18 may be disengaged from the drive shaft 24 by loosening and removing the single locking nut 104. Then, the nuts 170 may be loosened and removed from the threaded bolt shafts 168 so that the two-piece cast hub 184 may be separated into an obverse half 186 and a reverse half 188 that each may disengage from the tire 100. The tire 100 then may be repaired or replaced. To resecure the tire 100 to the two-piece cast hub 184, the obverse half 186 and reverse half 188 may be positioned within the opening of the tire 100 so that the tire bead is captured between the obverse rim 144 and the reverse rim 164 (without needing to stretch the tire bead). The obverse half 186 and reverse half 188 then may be aligned so that the threaded bolt shafts 168 may pass through the obverse half 186 and reverse half 188 seating the bolt heads 150 within the recessed bolt head wells 148. Tightening the nuts 170 onto the threaded bult shafts 168 clamps the obverse half 186 and reverse half 188 together capturing the tire beads of the tire 100 securely so that the tire may be inflated, if needed.

Figure 19:
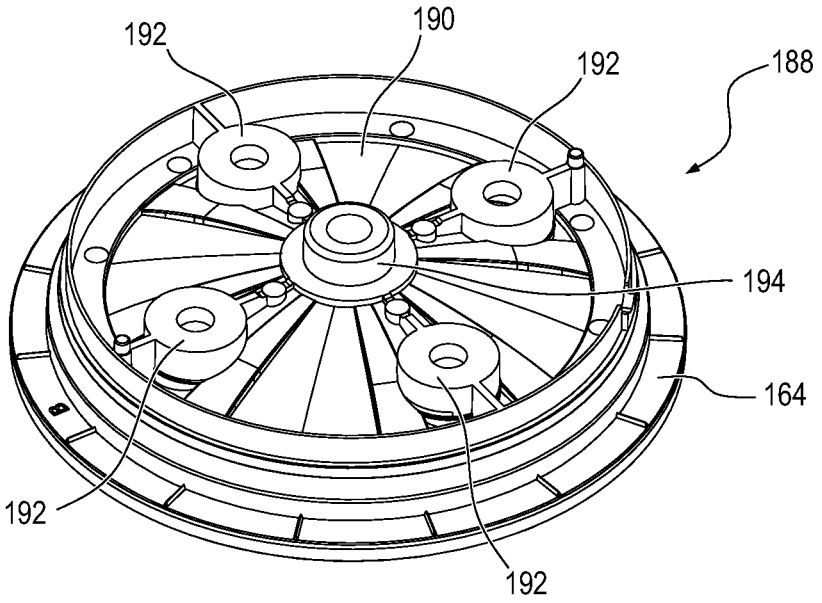
FIG. 19 is a perspective view of the reverse half of the two-piece cast hub showing its inside face with bolt-bore abutments and a central hub protrusion.
Figure 20:
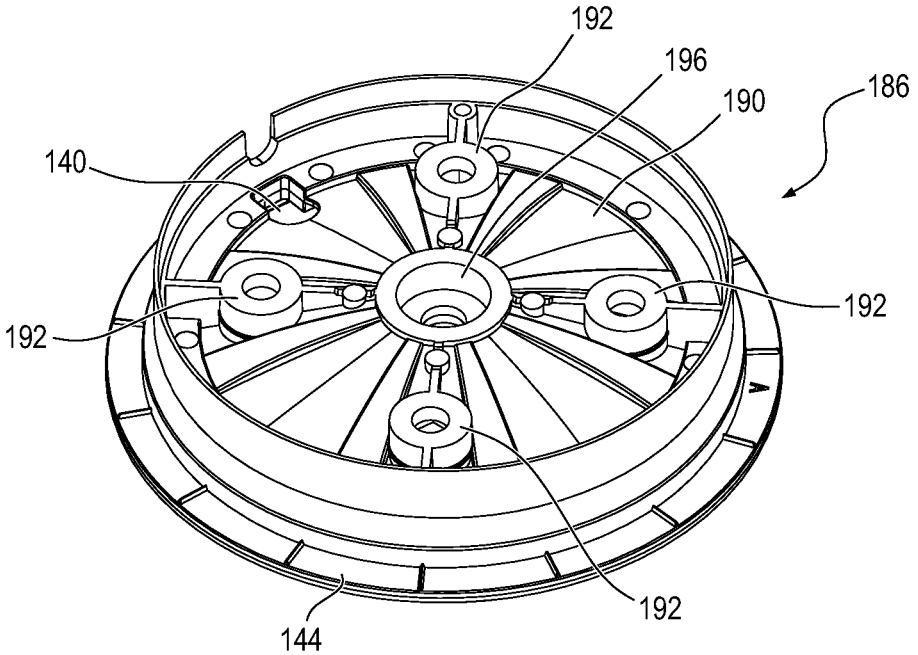
FIG. 20 is a perspective view of the obverse half of the two-piece cast hub showing its inside face with bolt-bore abutments and a central hub receptacle.

FIG. 19 depicts an exemplary reverse half 188 of the two-piece cast hub 184 showing its inside face 190 with bolt-bore abutments 192 and a central hub protrusion 194, while FIG. 20 depicts an exemplary obverse half 186 of the two-piece cast hub 184 showing its inside face 190 with bolt-bore abutments 192 and a central hub receptacle 196. The bolt-bore abutments 192 align and provide abutting support for clamping the two-piece cast hub 184 together. The central hub protrusion 194 of the reverse half 188 fits snugly into the central hub receptacle 196 of the obverse half 186 to provide abutting support for clamping the two-piece cast hub 184 together and may also have a key and guide to facilitate alignment and prevent undesired relative rotation of the two halves of the two-piece cast hub 184. Of course, the central hub receptacle 196 and the central hub protrusion 194 may be switched so that the central hub protrusion 194 is part of the obverse half 186 and the central hub receptacle 196 is part of the reverse half 188 without changing the operability of the two-piece cast hub 194.

Figure 21:
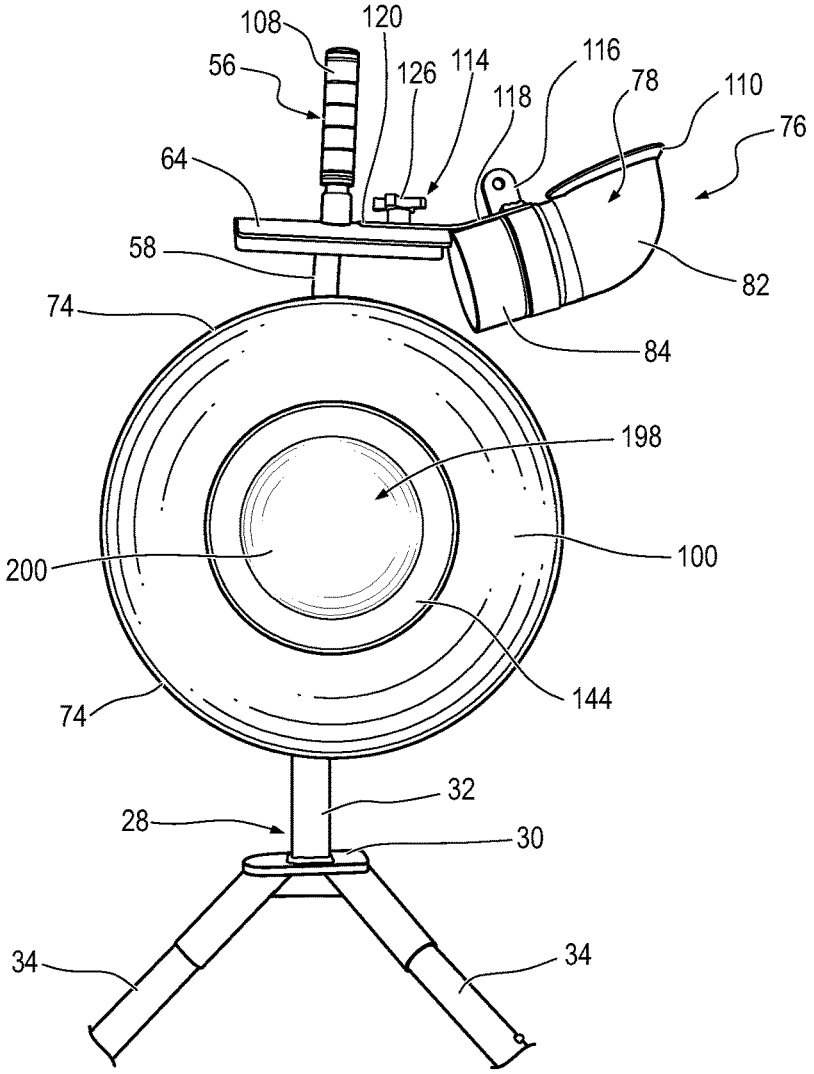
FIG. 21 is a side view of an exemplary wheel assembly showing the obverse side of the wheel assembly with the hub cap secured to the cast hub.

FIG. 21 is a side view of an exemplary wheel assembly 18 showing the obverse side 138 of the wheel assembly 18 with a hub cap 198 secured to the hub portion 98. The hub cap 198 is a safety feature that may be positioned to shield the hub portion 98 of the uncovered wheel assembly 18 by shielding at least some rotating portions of the hub portion 98 (which may be the obverse side 138 of the cast hub 102) from undesired touching or from snagging loose clothing or jewelry. As depicted, the hub cap 198 has a smooth outer dome surface 200 inhibiting injury from unintended touching of the rotating hub cap 198 and virtually eliminating snagging loose clothing or jewelry.

Figure 22:
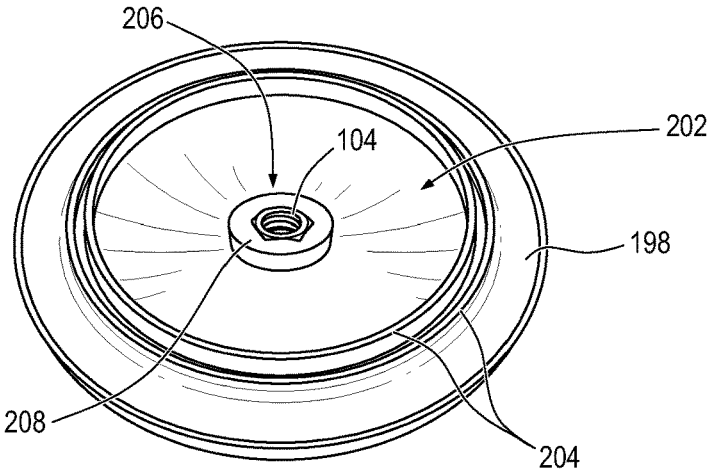
FIG. 22 is a perspective view of the concave underside of the hub cap of FIG. 21 showing circular ribs and an embedded nut for securing the wheel assembly to the drive shaft of the drive motor.

The concave underside 202 of the hub cap 198 is shown in FIG. 22 as having concentric ribs 204 giving the hub cap 198 structural integrity and an attachment assembly 206 comprising the single locking nut 104 embedded within a capturing enclosure 208. Other types of ribbing or structures may provide structural integrity for the hub cap 198. By threading the embedded single locking nut 104 onto the drive shaft 24, the wheel assembly 18 is secured for rotational movement and the otherwise exposed obverse side 138 of the hub portion 98 is covered, safely isolating the inner portions of the hub portion from undesired touching and inadvertent snagging of clothing or accessories.

In an alternative exemplary embodiment, the pitching machine 14 as depicted in FIGS. 23 and 24 may also comprise an optional ball feeder 210 secured to the ball feeder stub 116. The ball feeder 210 may be manual or automatic or a both, in combination, but as depicted, the ball feeder 210 is automatic or the combination because an electrical cord 212 and male plug 214 is shown as plugged into an outlet 216 (shown best on FIG. 24) on the housing assembly 22. Ball feeder 210 comprises a core 218 with a receiving cup 220, a helical ramp 230, a retaining wall 232, and a ball advancing control (not shown). The ball advancing control may be one of many types; for example, a movable stop, a rotatable stop, stop retractable trigger, and the like.

A tilt-adjustable mounting hub 234 may be disposed proximate the entry end 236 of the ball chute 78 elbow portion 82. The tilt-adjustable mounting hub 234 comprises a tiltable neck 238 connected between a hub head 240 and a tightening/loosening pivot pin assembly 242. The receiving cup 220 may receive the hub head 240 in a snug-fitting engagement. When loosened, the tiltable neck 238 pivots about the tightening/loosening pivot pin assembly 242 that is connected to the ball feeder stub 116 and when tightened, the tiltable neck 238 is secured into a tilt angle, thereby imparting the tilt angle to the to the ball feeder 210 and altering the angle of the helical ramp 230.

Tipping, tilting, or reorienting the ball feeder 210 can cause dispensing failure because the angle of the helical ramp 230 required for gravity to advance balls 12 may be insufficient. Also, the pitching machine 14 with the ball feeder 210 affixed may cause balls 12 to fall out of the ball feeder 210, rendering it inoperable to properly feed balls 12 into the ball chute 78. The tilting capability of the tilt-adjustable mounting hub 234 serves to compensate for the tilting movement of the pitching machine 14 by counter-tilting the tilt-adjustable mounting hub 234 so that the mounted ball feeder 210 is properly positioned to feed balls 12 into the ball chute 78 and maintains an angle sufficient for advancing balls 12 along the helical ramp 230 and/or an orientation that constrains balls 12 to travel the helical ramp 230 without falling out of the ball feeder 210.

The pitching machines 14 depicted in FIGS. 23 and 24 are additional exemplary embodiments of the uncovered multi-functional pitching machine 10. In particular, the pitching machine of FIG. 23 shows the finger shield 130 connected to the mounting assembly 16 and positioned proximate to and spaced from the hub portion 98 creating the vicinity gap 134 preventing fingers from passing therethrough. The finger shield 130 is configured such that the circular periphery 132 fits proximately spaced inside the reverse rim 164 and spaced proximate to and covering the reverse shoulder 162 to form the vicinity gap 134 to prevent fingers from accessing the space between the reverse rim 164 and the circular periphery 132 of the finger shield 130 while the wheel assembly 18 may rotate freely spaced from the finger shield 130. Configured in this manner, the finger shield 130 covers any wheel-balancing blind holes 172 on the hub portion inside of the reverse rim 164.

The pitching machine 14 of FIG. 24 is only slightly different. The finger shield 130 covers substantially the entirety of the hub portion 98 with the vicinity gap 134 being between the finger shield 130 and the covered reverse rim 164.

The pitching machines 14 of FIGS. 23 and 24 each depict power cord 182 as well as electrical cord 212 and male plug 214, one with the male plug 214 plugged into outlet 216 (FIG. 23) and the other (FIG. 24) with the male plug 214 unplugged from outlet 216. Both depictions show vents 244 for providing cooling air to cool the drive motor 20 (obscured from view). Additionally, the housing assembly 22 of FIG. 24 shows a reset button 246 as another feature accessible while operating the pitching machine.

Those skilled in the art will appreciate that the present embodiments are exemplary and representative and should not be limited to the embodiments shown and described.

The present invention may be embodied in other specific forms without departing from its structures, configurations, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed is:

1. A pitching machine enhanced with safety features for propelling balls, the pitching machine comprising:

a mounting assembly and a wheel assembly, the mounting assembly comprising a housing assembly and a finger shield attached to the housing assembly, the wheel assembly comprises a gripping portion and a hub portion, the wheel assembly not being covered;

a motor housed within the housing assembly, the motor having a drive shaft, the hub portion being connected to the drive shaft, the drive shaft conveys rotational force to rotate the wheel assembly, the housing assembly and finger shield being non-rotational relative to the motor;

wherein the hub portion is a cast hub having two cast sections an obverse half and a reverse half, the obverse half has an axis of rotation, an obverse side, and a first inside face, the reverse half has an axis of rotation, a reverse side, and a second inside face, each of the obverse side and the reverse side further comprises a rim, a shoulder and a central hub for receiving therethrough the drive shaft, and the cast hub being secured to the drive shaft by a single locking nut;

wherein the finger shield has a circular periphery positioned proximate to and spaced from the hub portion creating a vicinity gap preventing fingers from passing therethrough; and wherein rotational balancing of the wheel assembly is achieved by removing cast material mass creating blind holes in the reverse side shoulder, the blind holes being shielded from finger contact by the finger shield that prevents fingers from accessing the reverse side shoulder through the space between the reverse side rim and the circular periphery of the finger shield.

2. The pitching machine of claim 1, wherein:

the circular periphery of the finger shield fits proximately spaced entirely inside the reverse side rim and spaced proximate the reverse side shoulder to form the vicinity gap to prevent fingers from accessing the space between the reverse side rim and the circular periphery of the finger shield while the wheel assembly may rotate freely spaced from the finger shield.

3. The pitching machine of claim 1, wherein the wheel assembly comprises a pneumatic tire and the gripping portion comprises a portion of the pneumatic tire, the pneumatic tire being sealed between the rims of the obverse half and the reverse half by aligning and coupling the obverse half to the reverse half, the obverse side of the obverse half further comprises a plurality of recessed bolt head wells with bolt bores therethrough and a valve stem aperture, the reverse side of the reverse half further comprises recessed nut wells with bolt bores therethrough, the cast hub further comprising a plurality of bolts and nuts, the bolts having bolt heads, shanks and threads, the bolt heads are seated within the recessed bolt head wells thereby preventing bolt head rotation such that the shanks and threads pass through the bolt bores and the nuts nest within the recessed nut well thereby permitting the nuts to be threadedly tightened or loosened.

4. The pitching machine of claim 1, wherein the wheel assembly further comprises a hub cap disposed to shield at least a portion of the hub portion of the wheel assembly.

5. The pitching machine of claim 4, wherein the hub cap has a smooth outer dome surface and a concave underside.

6. The pitching machine of claim 5, wherein the concave underside of the hub cap has a capturing enclosure, the single locking nut being embedded within the capturing enclosure of the hub cap.

7. The pitching machine of claim 1 further comprising a pinch pad assembly, the pinch pad assembly comprises a pinch pad assembly anchor connected to the mounting assembly and a gooseneck structure with an anchoring end and a cantilevered end, the pinch pad anchoring end being disposed to receive the anchoring end of the gooseneck structure height-adjustably, the pinch pad connected to the cantilevered end and secured height-adjustably spaced from the gripping portion of the wheel assembly to accommodate the size of the ball to be propelled.

8. The pitching machine of claim 7, wherein the pinch pad assembly anchor comprises a threaded adjustment knob and a female threaded aperture and the anchoring end of the gooseneck structure has a plurality of height-capturing bores disposed at predetermined locations correlated to position the pinch pad in a non-slip fashion at predetermined heights spaced from the gripping portion of the wheel assembly, each of the height-capturing bores disposed at predetermined locations being selected from non-slot bores consisting of discrete bores and overlapping bores.

9. The pitching machine of claim 7 further comprising a ball chute assembly, the ball chute assembly comprising a ball chute having an elbow portion and a linear portion and a ball chute connector, the ball chute connector connects to the pinch pad and positions the ball chute such that a ball passing through the elbow portion and the linear portion of ball chute engages the gripping portion of the wheel assembly in pinching engagement between the pinch pad and the gripping portion of the wheel assembly to impart a propelling force to the ball, the configuration of the ball chute inhibits a person's hand from passing through the elbow portion and the linear portion to touch the rotating wheel assembly.

10. The pitching machine of claim 9, wherein the ball chute connector further comprises a ball-feeder attachment stub for attaching a ball feeder to the ball chute assembly and positioning the ball feeder to advance balls into the elbow portion of the ball chute.

11. The pitching machine of claim 9, wherein the elbow portion of the ball chute further comprises a flared lip to facilitate receiving the ball into the elbow portion.

12. The pitching machine of claim 7 further comprising s a tiltable connection that supports the mounting assembly tiltably upon a support assembly and the pinch pad assembly further comprises a tilt-assist grip that is graspable with one hand to stabilize and deter undesired tilting of the mounting assembly during tightening or loosening of the tiltable connection.

* * * * *